US009340018B2

(12) United States Patent
Kawakubo et al.

(10) Patent No.: US 9,340,018 B2
(45) Date of Patent: May 17, 2016

(54) INKJET HEAD INCLUDING NOZZLE PLATE PROVIDED WITH PIEZOELECTRIC ELEMENT

(71) Applicants: KABUSHIKI KAISHA TOSHIBA, Tokyo (JP); TOSHIBA TEC KABUSHIKI KAISHA, Tokyo (JP)

(72) Inventors: Takashi Kawakubo, Kanagawa (JP); Ryuichi Arai, Shizuoka (JP); Ryutaro Kusunoki, Shizuoka (JP); Osamu Takagi, Tokyo (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/075,423

(22) Filed: Nov. 8, 2013

(65) Prior Publication Data

US 2015/0062254 A1 Mar. 5, 2015

(30) Foreign Application Priority Data

Aug. 30, 2013 (JP) ..... 2013-179472

(51) Int. Cl.
*B41J 2/015* (2006.01)
*B41J 2/045* (2006.01)
*B41J 2/14* (2006.01)

(52) U.S. Cl.
CPC ..... *B41J 2/14201* (2013.01); *B41J 2202/15* (2013.01)

(58) Field of Classification Search
None
See application file for complete search history.

(56) References Cited

U.S. PATENT DOCUMENTS

| | | | | |
|---|---|---|---|---|
| 2001/0007462 | A1 | 7/2001 | Jeong et al. | |
| 2002/0135639 | A1 | 9/2002 | Cruz-Uribe | |
| 2002/0135644 | A1 | 9/2002 | Cruz-Uribe | |
| 2002/0149653 | A1 * | 10/2002 | Sasaki et al. | 347/70 |
| 2003/0231227 | A1 * | 12/2003 | Kim | 347/63 |
| 2004/0140732 | A1 * | 7/2004 | Truninger et al. | 310/300 |
| 2012/0056947 | A1 * | 3/2012 | Tanuma et al. | 347/71 |
| 2013/0100211 | A1 | 4/2013 | Kawakubo et al. | |

FOREIGN PATENT DOCUMENTS

| | | | |
|---|---|---|---|
| JP | 2001-191520 | A | 7/2001 |
| JP | 2002-301433 | A | 10/2002 |
| JP | 2002-359981 | A | 12/2002 |
| JP | 2010-105164 | A | 5/2010 |
| JP | 2011-056939 | A | 3/2011 |
| JP | 2012-071587 | A | 4/2012 |

OTHER PUBLICATIONS

Japanese Office Action with English translation, Patent Application No. 2013-179472, dated Mar. 17, 2015.

* cited by examiner

*Primary Examiner* — Erica Lin
(74) *Attorney, Agent, or Firm* — Patterson & Sheridan, LLP

(57) ABSTRACT

An inkjet head includes: a pressure chamber in which ink is filled; a nozzle plate which is provided on a first surface of the pressure chamber and which includes a nozzle communicating with the pressure chamber; and a planar drive section which is formed on the nozzle plate so as to extend from above a partition wall of the pressure chamber to above the pressure chamber, excluding a hole area around the nozzle and which has a piezoelectric body.

18 Claims, 19 Drawing Sheets

Table 1

| | |
|---|---|
| Diameter of pressure generating chamber | 200 μm |
| Thickness of nozzle plate | 4 μm |
| Diameter of nozzle opening portion | 20 μm |
| Diameter of nozzle plate center portion | 100 μm |
| Thickness of lower electrode | 0.1 μm |
| Thickness of piezoelectric film | 2 μm |
| Thickness of upper electrode | 0.1 μm |

Table 2

| | |
|---|---|
| Diameter of pressure generating chamber | 200 μm |
| Thickness of nozzle plate | 4 μm |
| Diameter of nozzle opening portion | 20 μm |
| Diameter of nozzle plate center portion | 120 μm |
| Diameter of protective film | 40 μm |
| Thickness of lower electrode | 0.1 μm |
| Thickness of piezoelectric film | 2 μm |
| Thickness of upper electrode | 0.1 μm |

Table 3

| | |
|---|---|
| Width of pressure generating chamber | 100 μm |
| Length of pressure generating chamber | 400 μm |
| Thickness of nozzle plate | 4 μm |
| Diameter of nozzle opening portion | 20 μm |
| Width of nozzle plate center portion | 30 μm |
| Thickness of lower electrode | 0.1 μm |
| Thickness of piezoelectric film | 2 μm |
| Thickness of upper electrode | 0.1 μm |

INKJET HEAD INCLUDING NOZZLE PLATE PROVIDED WITH PIEZOELECTRIC ELEMENT

CROSS-REFERENCE TO RELATED APPLICATIONS

This application is based upon and claims the benefit of priority from the prior the Japanese Patent Application No. 2013-179472, filed on Aug. 30, 2013, and the entire contents of which are incorporated herein by reference.

FIELD

Embodiments of the present invention relate to an inkjet head that ejects ink from a nozzle and an inkjet recording apparatus.

BACKGROUND

There is known a center piezoelectric driving type inkjet head that drives a planar piezoelectric element disposed on a nozzle plate at a center area of a pressure chamber to eject ink from a nozzle.

In the center piezoelectric driving type inkjet head, if an external wiring is run from a partition wall area of the pressure chamber to the center area thereof to be connected to an electrode of the piezoelectric element, the connection portion may be peeled off, or the external wiring may be cracked. Further, if a connection space between the electrode of the piezoelectric element and the external wiring is not symmetrical, there is a possibility that ejection characteristics of ink from the nozzle are impaired. Further, at an adjacent area between the piezoelectric element and nozzle, an inner periphery of the piezoelectric element is overlapped with a nozzle opening portion due to displacement occurring at manufacturing time, which may result in a reduction in manufacturing yield.

DETAILED DESCRIPTION

According to the embodiments, there is provided an inkjet head including: a pressure chamber in which ink is filled; a nozzle plate which is provided on a first surface of the pressure chamber and which includes a nozzle communicating with the pressure chamber; and a planar drive section which is formed on the nozzle plate so as to extend from a position above a partition wall of the pressure chamber to a position above the pressure chamber, excluding a hole area around the nozzle and which includes a piezoelectric body.

Hereinafter, embodiments will be described.

First Embodiment

Figure 1:
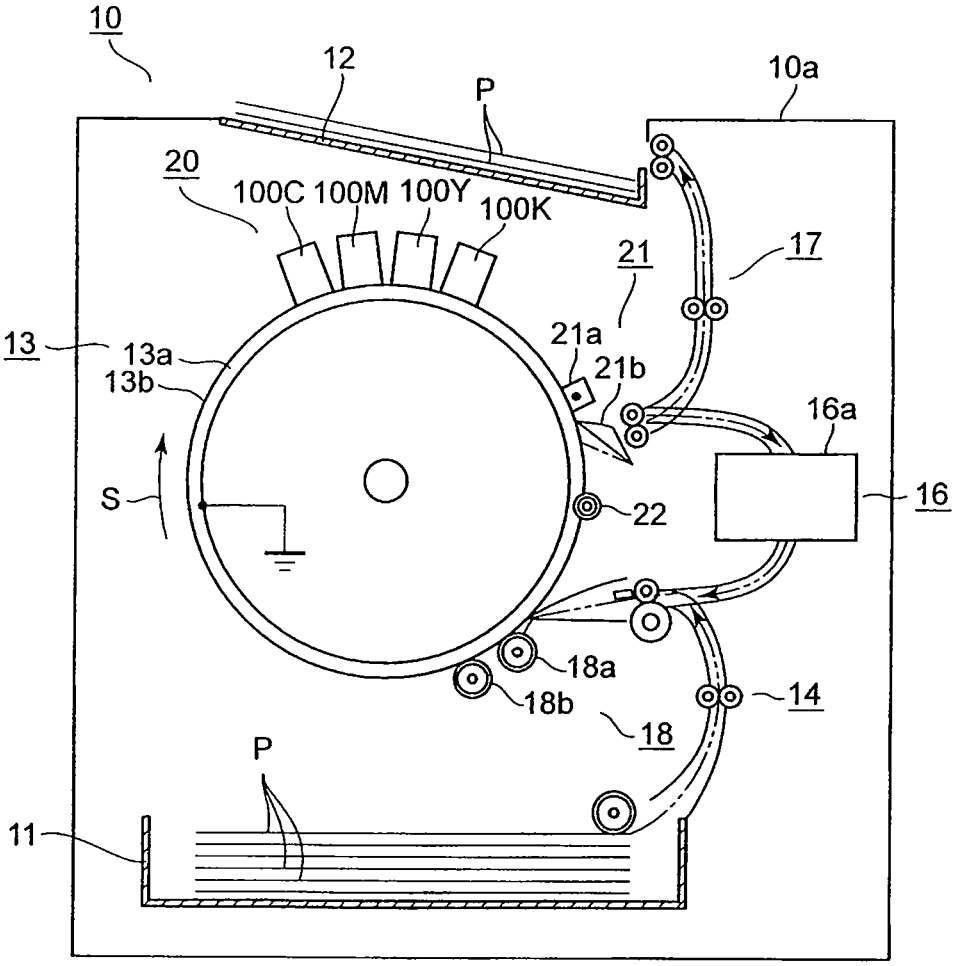
FIG. 1 is a schematic configuration view illustrating an inkjet printer of a first embodiment.

An inkjet recording apparatus of a first embodiment will be described with reference to FIG. 1 to FIG. 11. FIG. 1 illustrates an example of an inkjet printer 10 as the inkjet recording apparatus. The inkjet printer 10 illustrated in FIG. 1 performs various processing such as image formation while conveying a recording paper P as a recording medium. The inkjet printer 10 includes a casing 10*a*, a paper cassette 11, a discharge tray 12, a retaining roller 13, a paper conveying section 14 as a conveyance section, a reversing section 16, and a paper discharge conveying section 17. Further, the inkjet printer 10 includes, around the retaining roller 13, a retaining section 18, an image forming section 20, a peeling section 21, and a cleaning section 22.

The paper cassette 11 houses the recording paper P before printing. The discharge tray 12 houses the recording paper P discharged from the casing 10*a* after image formation. The paper conveying section 14 supplies the recording paper P picked up from the paper cassette 11 to the retaining roller 13.

The retaining roller 13 includes a cylindrical conductive (for example aluminum) frame 13*a* and a thin insulating layer 13*b* formed on a surface of the cylindrical frame 13*a*. The cylindrical frame 13*a* is grounded. The retaining roller 13 rotates in a direction of an arrow s while retaining the recording paper P on its surface to thereby convey the recording paper P. The retaining section 18 includes a pressing roller 18*a* that presses the recording paper P against the retaining roller 13 and a charging roller 18*b* that makes the recording paper P adhered to the retaining roller 13 by electrostatic force resulting from charging.

The image forming section 20 includes, e.g., an inkjet heads 100C, 100M, 100Y, and 100K. The inkjet heads 100C, 100M, 100Y, and 100K eject cyan ink, magenta ink, yellow ink, and black ink, respectively, to thereby print a desired image on the recording paper P retained on a surface of the retaining roller 13.

A peeling section 21 includes a neutralizing charger 21*a* and a peeling claw 21*b*. The neutralizing charger 21*a* supplies electric charge to the recording paper P to neutralize the recording paper P. The peeling claw 21*b* peels off the recording paper P from the surface of the retaining roller 13. The recording paper P after printing is peeled off from the retaining roller 13 by the peeling section 21 and is then discharged onto the discharge tray 12 by the paper discharge conveying section 17. In the case of two-sided printing, the recording paper P peeled off from the retaining roller 13 by the peeling section 21 and is then reversed by the reversing section 16 to be supplied to the retaining roller 13 once again. The reversing section 16 includes a reversing path 16*a* for switching back the recording paper P to reverse the recording paper P peeled off from the retaining roller 13. The cleaning section 22 cleans the surface of the retaining roller 13.

The following describes the inkjet heads 100C, 100M, 100Y, and 100K of the image forming section 20. The inkjet heads 100C, 100M, 100Y, and 100K have the same configuration except the ink to be used. The configuration of each of the inkjet heads 100C, 100M, 100Y, and 100K will be described using common reference numerals.

Figure 2:
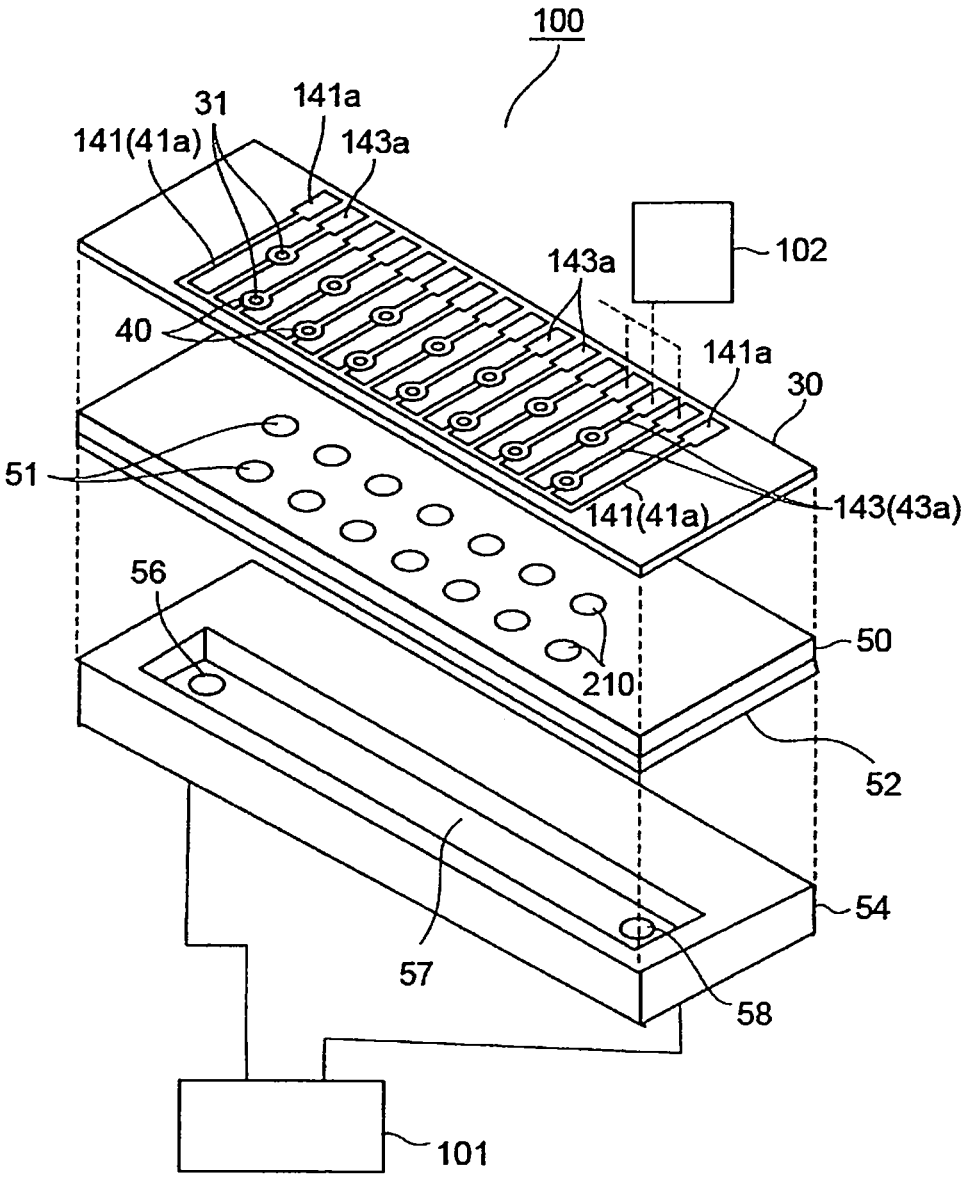
FIG. 2 is a schematic exploded perspective view illustrating an inkjet head of the first embodiment.

FIG. 2 illustrates an example of a piezoelectric MEMS (Micro Electro Mechanical System) type inkjet head 100. The inkjet 100 includes a pressure chamber structure 50, a back plate 52, a nozzle plate 30, and an ink channel structure 54. The inkjet 100 connects to an ink tank 101 and a controller 102.

The nozzle plate 30 is formed on a first surface of the pressure chamber structure 50. The back plate 52 is disposed on a surface of the pressure chamber structure 50 that opposes the nozzle plate 30.

The inkjet head 100 fills ink supplied from the ink tank 100 in a pressure generating chamber 51 as a pressure chamber through the ink channel structure 54. The pressure generating chamber 51 is formed in the pressure chamber structure 50 and has a circular shape having a diameter of a as viewed from above. The inkjet head 100 ejects the ink filled in the pressure generating chamber 51 as ink droplets from a plurality of nozzles 31 formed in the nozzle plate 30. The plurality of nozzles 31 are arranged in, e.g., two rows in the nozzle plate 30.

The ink channel structure 54 includes an ink inflow port 56, an ink channel 57, and an ink discharge port 58. In the ink channel structure 54, ink supplied to the ink channel 57 through the ink inflow port 56 flows into the pressure generating chamber 51 through an ink hole 53 (FIG. 4) of the back plate 52. The ink in the ink channel 57 is discharged to the ink tank 101 through the ink discharge port 58. That is, the ink is circulated between the ink tank 101 and ink channel 57 of the inkjet head 100.

Figure 3:
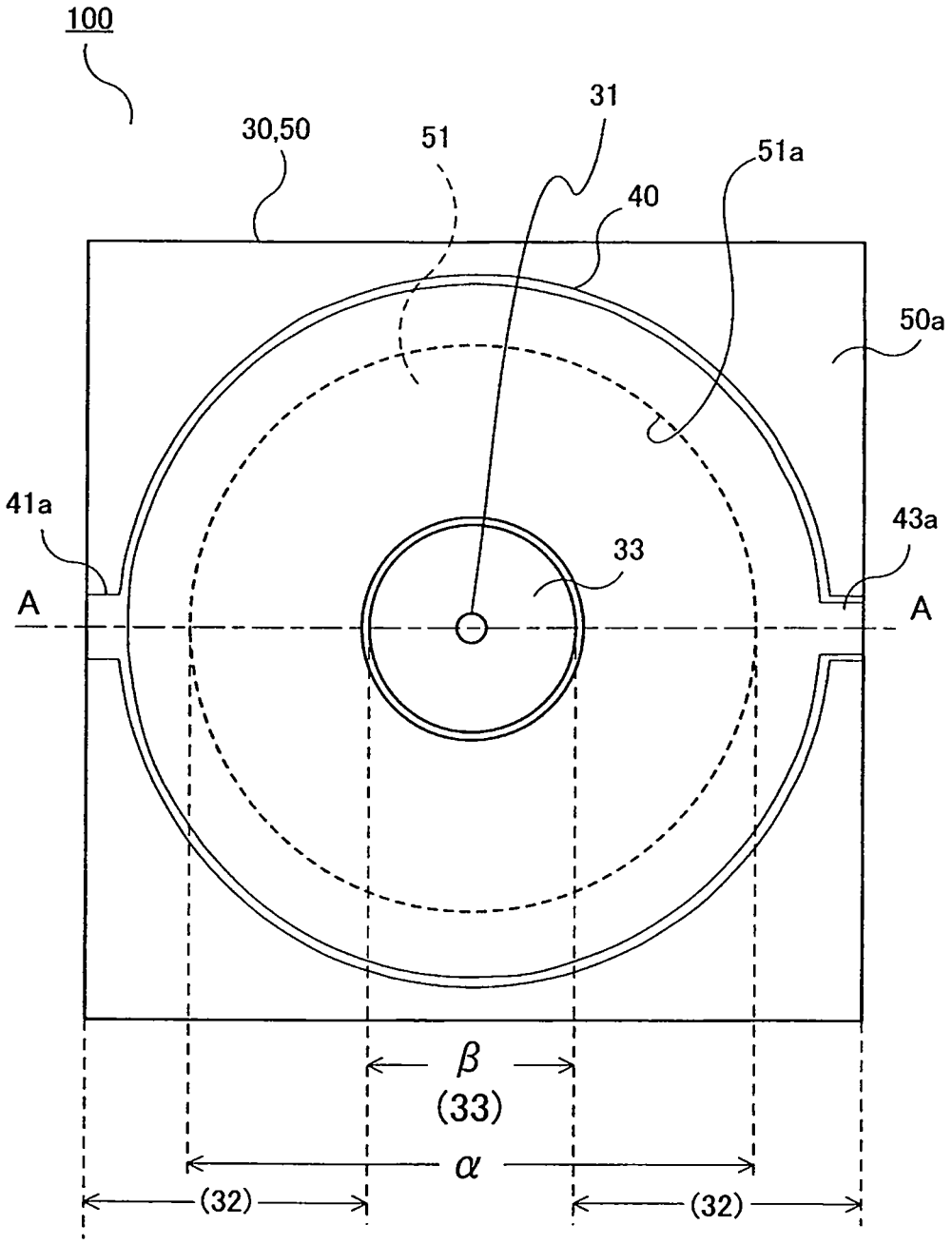
FIG. 3 is a top view partly illustrating the inkjet head of the first embodiment.
Figure 4:
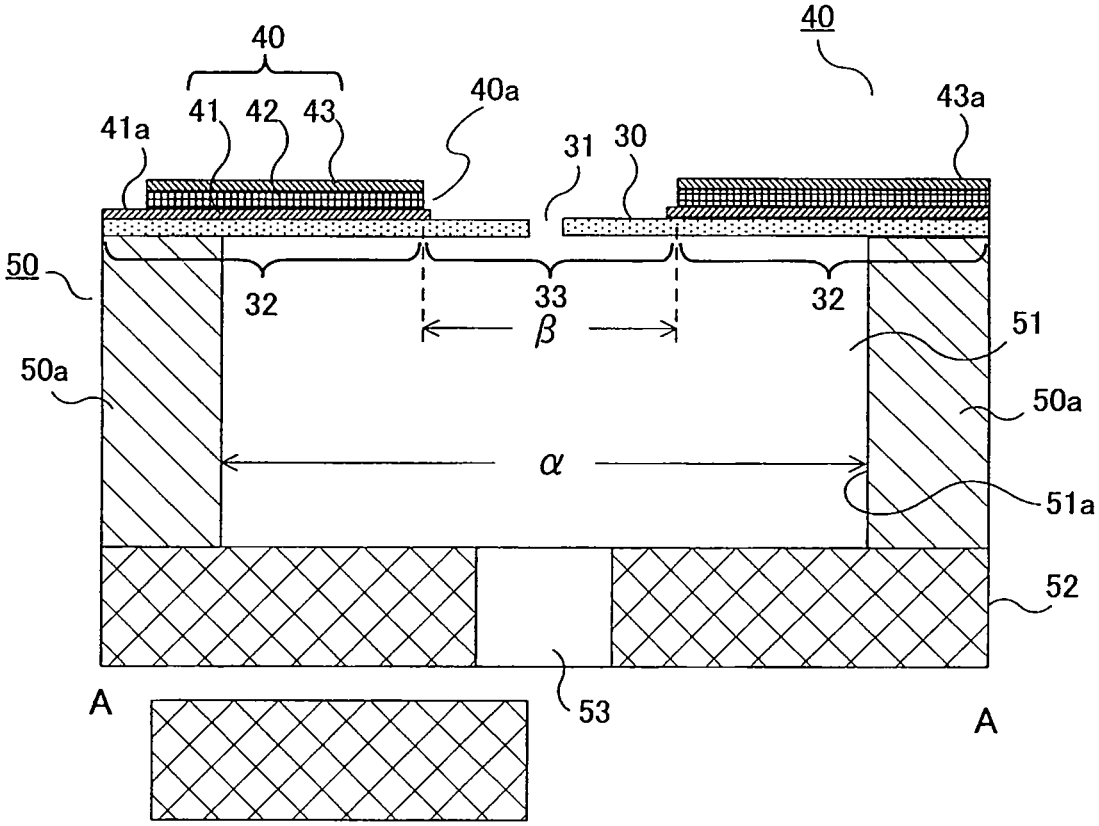
FIG. 4 is a schematic cross-sectional view of the inkjet head taken along a line A-A of FIG. 3.

As illustrated in FIGS. 3 and 4, the nozzle plate 30 includes a planar piezoelectric element 40 as a drive section which around the nozzle 31. The nozzle plate 30 is deformed in a thickness direction thereof by action of the planar piezoelectric element 40. The inkjet head 100 ejects the ink from the nozzle 31 by energy change generated in the pressure generating chamber 51 due to the deformation of the nozzle plate 30.

The pressure generating chamber 51 is formed in the pressure chamber structure 50 formed of, e.g., a silicon substrate (Si substrate) so as to have a circular shape as viewed from above. A thickness of the Si substrate of the pressure chamber structure 50 is set to, e.g., 100 μm to 600 μm. It is preferably to set the thickness of the Si substrate to about 150 μm to 250 μm in order to increase an arrangement density of the pressure generating chambers 51 each having a circular inner periphery 51*a* while keeping rigidity of a partition wall 50*a* between the adjacent pressure generating chambers 51. The pressure generating chamber 51 is surrounded by the nozzle plate 30, partition wall 50*a*, and back plate 52.

The nozzle plate 30 is formed of a silicon dioxide film ($SiO_2$ film) integrally formed with the pressure chamber structure 50 and is integrally formed with the partition wall 50*a* of the pressure chamber structure 50. A thickness of the nozzle plate 30 is set to, e.g., 1 μm to 5 μm.

The $SiO_2$ film is suitably used as the nozzle plate 30 since it is amorphous and can thus be deformed uniformly. Further, also in terms of easiness of manufacturing of a film stable in composition and characteristics, the amorphous $SiO_2$ film is preferably used. Furthermore, also in terms of high consistency with a conventional semiconductor manufacturing process, the amorphous $SiO_2$ film is preferably used. A material of the nozzle plate 30 is not limited to the $SiO_2$ film. It is also preferable to use an amorphous silicon nitride film (SiN film) as the nozzle plate in order to achieve uniform deformation.

The nozzle 31 is formed in the nozzle plate 30 by, e.g., etching. Diameters of the pressure generating chamber 51 and nozzle 31 are optimized in accordance with an amount of the ink to be ejected from the nozzle 31, ink ejection speed, ink ejection frequency, and the like. For example, in a case where 360 ink droplets per one inch are ejected, it is necessary to form the nozzle 31 of a groove width of several tens of μm with accuracy.

The piezoelectric element 40 is disposed around each nozzle 31 and includes a piezoelectric film 42 as a piezoelectric body and lower and upper electrodes 41 and 43 sandwiching therebetween the piezoelectric film 42. The lower electrode 41 has an extended part 41*a* serving as a part of an external wiring 141. The external wiring 141 connects to two terminal portions 141*a*. The upper electrode 43 has an extended part 43*a* serving as a part of an external wiring 143. The extended part 43*a* is extended with the piezoelectric film 42 and the lower electrode 41 which are formed under the upper electrode 43. The external wirings 143 are arranged side by side between the two terminal portions 141*a* of the lower electrode 41 and are connected to a plurality of terminal portions 143*a*, respectively.

The controller 102 controls ON and OFF of application of voltage to the terminal portions 143*a* to supply an electric signal to the piezoelectric element 40. The piezoelectric element 40 is formed on the nozzle plate 30 and above a peripheral area 32 of the pressure generating chamber 51. The piezoelectric element 40 is not formed in a circular center area 33 having a diameter β as a hole area of the nozzle plate 30 which located around the nozzle 31. The piezoelectric element 40 has an annular shape extending, toward the nozzle 31, from above the partition wall 50*a* of the nozzle plate 30 up to a portion above the pressure generating chamber 51. The center area 33 of the nozzle plate 30 where the annular piezoelectric element 40 is not formed can be freely deformed in the thickness direction thereof.

A width of the center area 33 of the nozzle plate 30 is not especially limited as long as the nozzle plate 30 can be deformed by the action of the piezoelectric element 40.

As the piezoelectric film 42 of the piezoelectric element 40, a piezoelectric material having a large electrostrictive constant, such as lead zirconate titanate ((Pb(Zr, Ti)$O_3$, PZT) is suitably used. If the PZT is used as the piezoelectric film 42, noble metal such as Pt (platinum), Au (gold), and Ir (iridium) or a conductive oxidative product such as SrRuO3 (ruthenium acid strontium) is suitably used as a material of the lower electrode 41 or upper electrode 43.

As the piezoelectric film 42, a piezoelectric material suitably used for a silicon process, such as aluminum nitride (AlN) or zinc dioxide ($ZnO_2$) can be used. If the aluminum nitride or zinc dioxide is used as the piezoelectric film 42, a generic electrode material or wiring material, such as Al (aluminum) or Cu (copper) can be used as the material of the lower electrode 41 or upper electrode 43.

The following describes an example of a manufacturing method of the inkjet head 100.

Figure 5A:
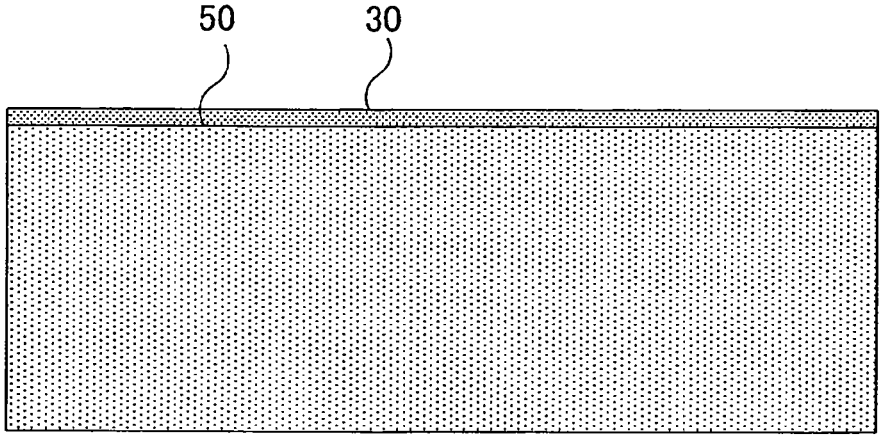
FIG. 5*a* is a schematic cross-sectional view illustrating a state where a nozzle plate is formed on a pressure chamber structure of the first embodiment.

A silicon dioxide film ($SiO_2$ film) is formed on the first surface of the pressure chamber structure 50 by a CVD method (Chemical Vapor Deposition method) as the nozzle plate 30 (FIG. 5*a*).

Then, the piezoelectric element 40 is formed on the nozzle plate 30. A film formation process and a patterning process are repeated for formation of the piezoelectric element 40. The film formation process is performed by a sputtering method or the CVD method. The patterning process is performed by, e.g., photolithography and reactive ion etching. For example, in the patterning process, a photosensitive resist is used to form an etching mask on a film, followed by etching of the film material, and then the etching mask is removed.

Using, e.g., a sputtering method to sequentially form, a Pt (platinum) film as a material of the lower electrode 41, a PZT (Lead Zirconate Titanate) film as the material of the piezoelectric film 42, and a Pt (platinum) film as a material of the upper electrode 43 are made.

Figure 5B:
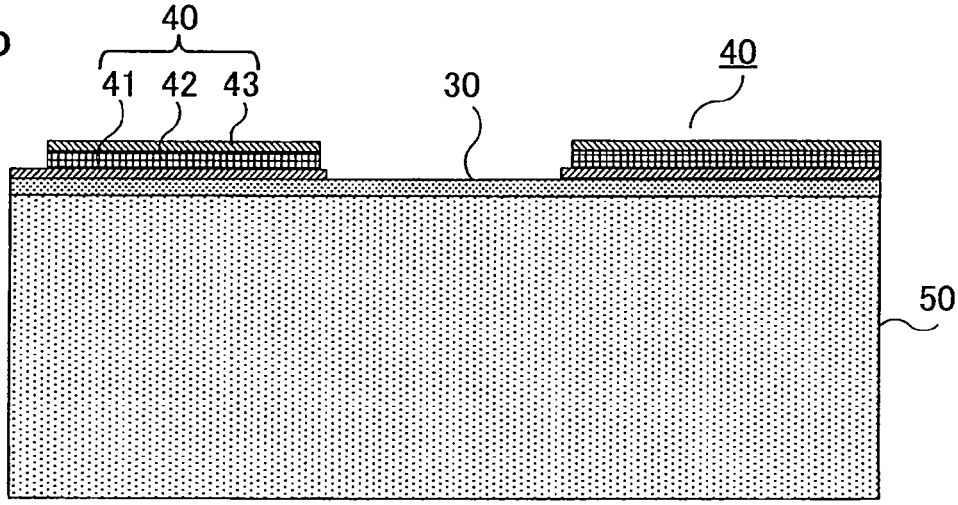
FIG. 5*b* is a schematic cross-sectional view illustrating a state where a piezoelectric element is formed on the nozzle plate of the first embodiment.

Then, the upper Pt (platinum) film and PZT (Lead Zirconate Titanate) film are patterned by the photolithography and reactive ion etching to form the upper electrode 43 and piezoelectric film 42. Then, the lower Pt (platinum) film is patterned by the photolithography and reactive ion etching to form the lower electrode 41 (FIG. 5*b*). The lower electrode 41 or upper electrode 43 may each have a multilayer structure including, e.g., a Ti (titanium) film and Pt (platinum) film.

Figure 5C:
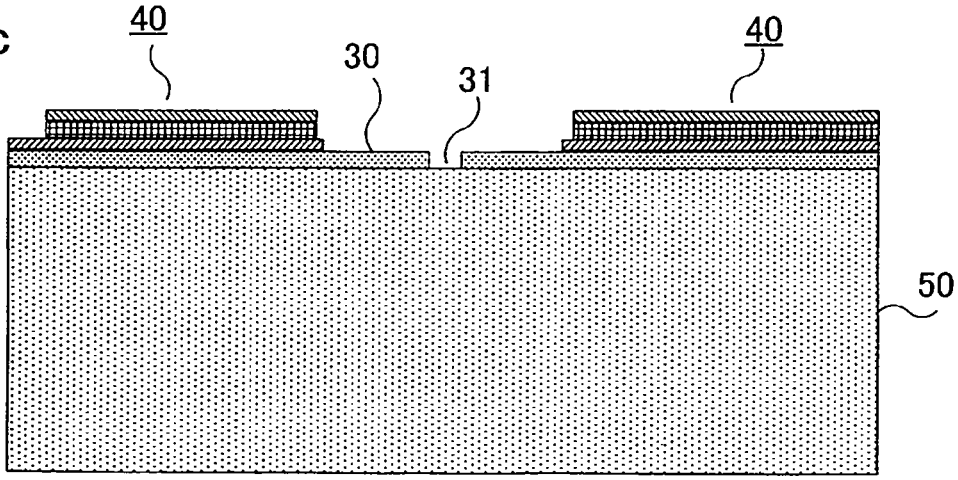
FIG. 5*c* is a schematic cross-sectional view illustrating a state where a nozzle is formed in the nozzle plate of the first embodiment.

Then, the nozzle plate 30 is patterned by the photolithography and reactive ion etching to form the nozzle 31 (FIG. 5*c*).

Figure 5D:
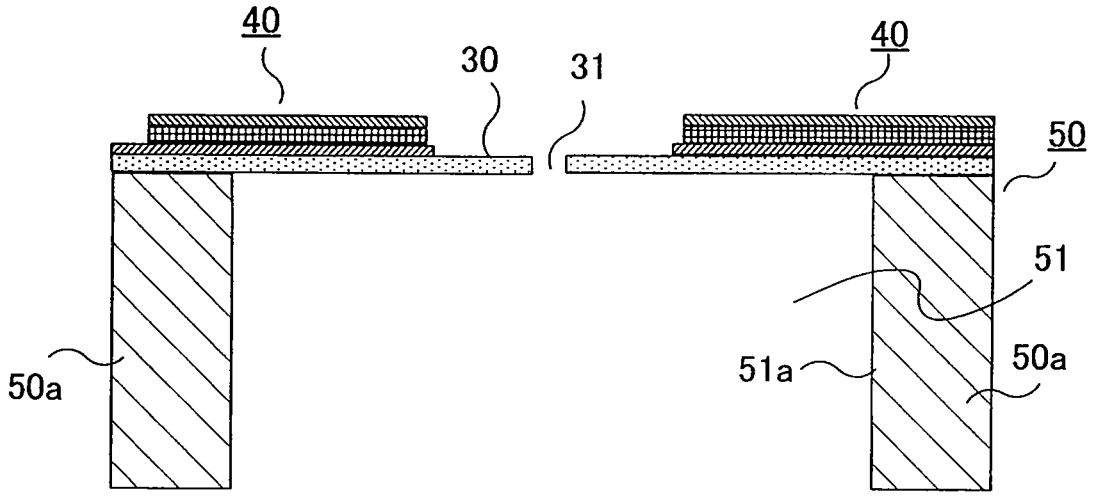
FIG. 5*d* is a schematic cross-sectional view illustrating a state where a partition wall is formed in the pressure chamber structure of the first embodiment.

Then, the pressure chamber structure 50 is patterned by the photolithography and reactive ion etching from a side opposite to the nozzle plate up to a position contacting the nozzle plate 30 to form the partition wall 50*a* (FIG. 5*d*).

Figure 5E:
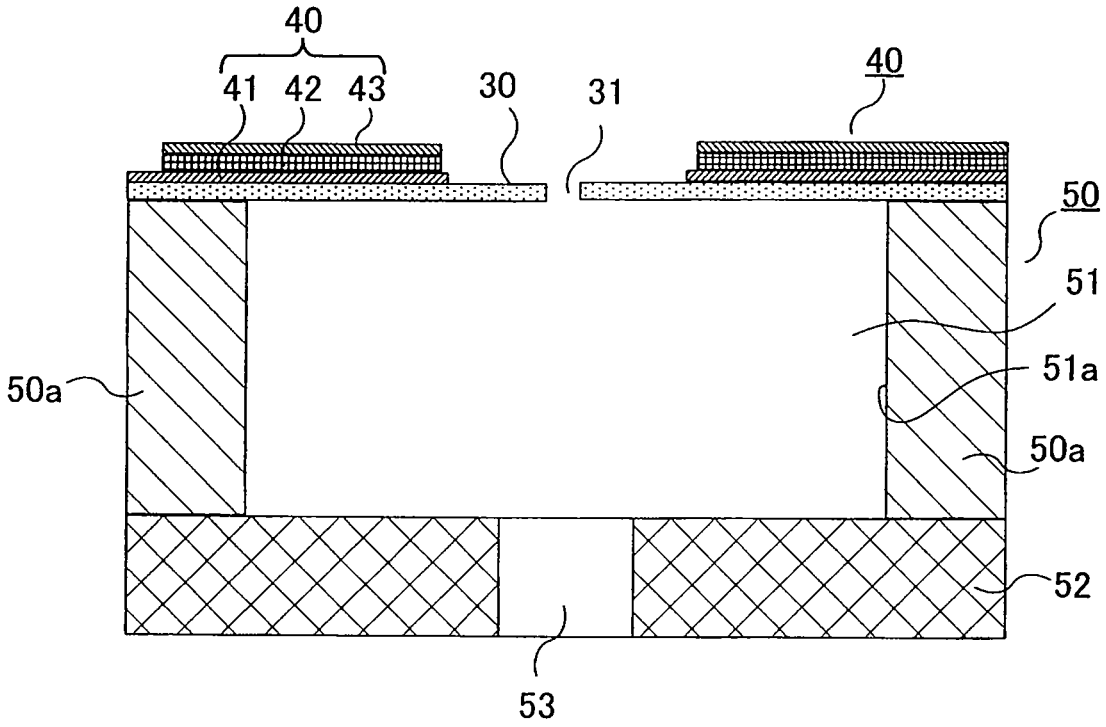
FIG. 5*e* is a schematic cross-sectional view illustrating a state where a back plate is bonded to the pressure chamber structure of the first embodiment.

Then, the back plate 52 is bonded to a side of the partition wall 50*a* that is opposed to the nozzle plate 30 to form the pressure generating chamber 51 (FIG. 5*e*).

After that, the ink channel structure 54 is bonded to the pressure chamber structure 50 to form the inkjet head 100. The back plate 52 is intervened between the nozzle plate 30 and the ink channel structure 54

The pressure generating chamber 51 of the pressure chamber structure 50 communicates with the ink channel 57 of the ink channel structure 54 through the ink hole 53 of the back plate 52.

In a series of the manufacturing processes of the inkjet head 100, a large number of inkjet head chips are formed simultaneously on one silicon wafer, and then the silicon wafer is divided into individual inkjet head chip for example. In this manner, a large number of inkjet head chips are formed simultaneously to allow manufacturing of the inkjet head 100.

Example 1

As Example 1, a Finite Element Method was used to simulate characteristics of the inkjet head 100 of the first embodiment. Example 1 is an example of simulation of characteristics of the inkjet head 100 if drive voltage is applied to the piezoelectric film 42 through the lower and upper electrodes 41 and 43 of the piezoelectric element 40.

Figures 6, 7:
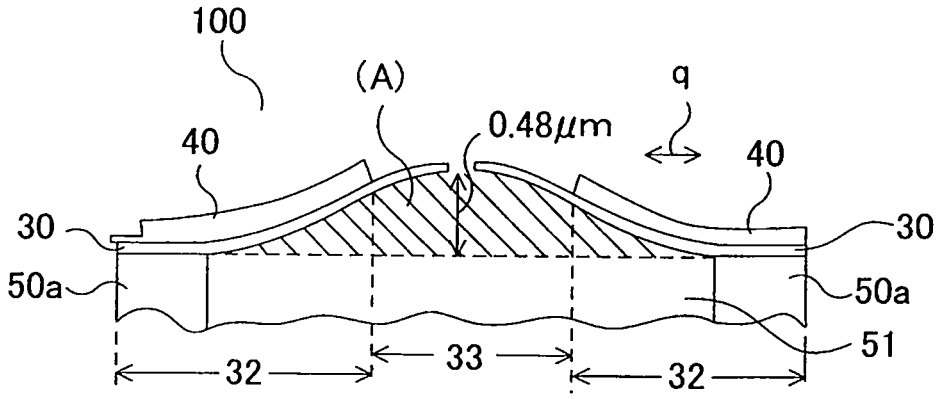
FIG. 6 is a table (Table 1) listing dimensions of main components of the inkjet head of Example 1 of the first embodiment.
FIG. 7 is a pattern diagrams illustrating deformation of the nozzle plate of Example 1 of the first embodiment.

As an example, dimensions of main components of the inkjet head 100 used in the simulation are listed in Table 1 of FIG. 6. The diameter α of the pressure generating chamber 51 of the silicon pressure chamber structure 50 of the inkjet head 100 was set to 200 μm. The thickness of the nozzle plate 30 of silicon dioxide ($SiO_2$) formed on the surface of the pressure chamber structure 50 by the CVD method was set to 4 μm. The diameter of the nozzle 31 formed in the nozzle plate 30 was set to 20 μm.

The diameter of the center area 33 of the piezoelectric element 40 on the nozzle plate 30 was set to 100 μm. The thicknesses of the lower electrode 41, piezoelectric film 42, and upper electrode 43 of the piezoelectric element 40 were set to 0.1 μm, 2 μm, and 0.1 μm, respectively. The platinum (Pt) was used as the lower and upper electrodes 41 and 43, and the lead zirconate titanate (PZT) was used as the piezoelectric film 42. A piezoelectric constant number d31 of the piezoelectric film 42 was set to −100 pm/V. Film residual stresses of the nozzle plate 30 and piezoelectric film 42 were set to 0 MPa and 56 MPa, respectively.

FIG. 7 is a pattern diagrams illustrating deformation of the nozzle plate 30 which is calculated by a simulator if 30 V is applied between the lower and upper electrodes 41 and 43. The piezoelectric film 42 contracts in a planar direction indicate by arrow q by the voltage application.

The contraction of the piezoelectric film 42 causes the peripheral area 32 of the nozzle plate 33 to be deformed in a concave shape by bimorph effect. The center area 33 of the nozzle plate 30 where the piezoelectric film 42 is not formed is deformed in a convex vertically with respect to the planar direction with the deformation of the peripheral area 32.

Calculation based on the simulation performed under the condition that 30 V is applied between the lower and upper electrodes 41 and 43 revealed that a vertical direction deformation of the nozzle plate 30 at a position of the nozzle 31 (center of the pressure generating chamber 51) was 0.48 μm. A drive volume of the entire nozzle plate 30 denoted as a shaded area (A) of FIG. 7 was 5.1 pl (pico-liter).

A drive pressure required to deform the nozzle plate 30 by 0.48 μm at the center of the pressure generating chamber 51 was 0.28 MPa, and total drive energy of the inkjet head 100 of Example 1 was calculated to be 0.71 nJ.

For example, if an ink droplet containing organic solvent or aqueous solution with a volume of 5 pl (pico-liter) is ejected at a speed of 10 m/s, a sum of surface energy and kinetic energy of the ink droplet is about 0.1 nJ to 0.3 nJ. Thus, it turns out that the inkjet head 100 of Example 1 has drive energy sufficient enough to eject the ink droplet of the ink in the pressure generating chamber 51 having a volume of about 5 pl (pico-liter) at a speed of 10 m/s from the nozzle 31.

Figure 8:
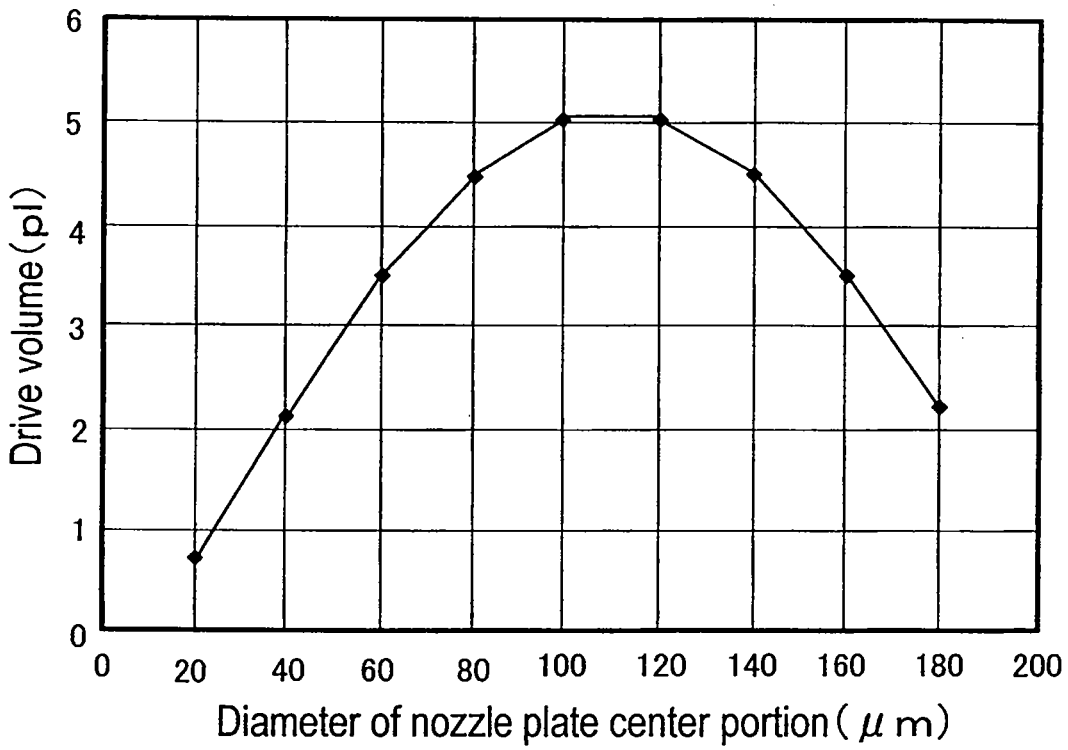
FIG. 8 is a graph illustrating a variation in drive volume of the inkjet head relative to a variation in a diameter of a center area of the nozzle plate in Example 1 of the first embodiment.

The following describes variations in the drive volume and total drive energy of the inkjet head 100 if the diameter β of the center area 33 of the nozzle plate 30 is varied in Example 1. In Example 1, the Finite Element Method was used to perform simulation by varying the diameter β of the center area 33. The variation in the diameter β of the center area 33 varies the drive volume of the inkjet head 100 as illustrated in FIG. 8. If the diameter β of the center area 33 of the nozzle plate 30 is 100 μm to 120 μm, the drive volume assumes a maximum value.

Figure 9:
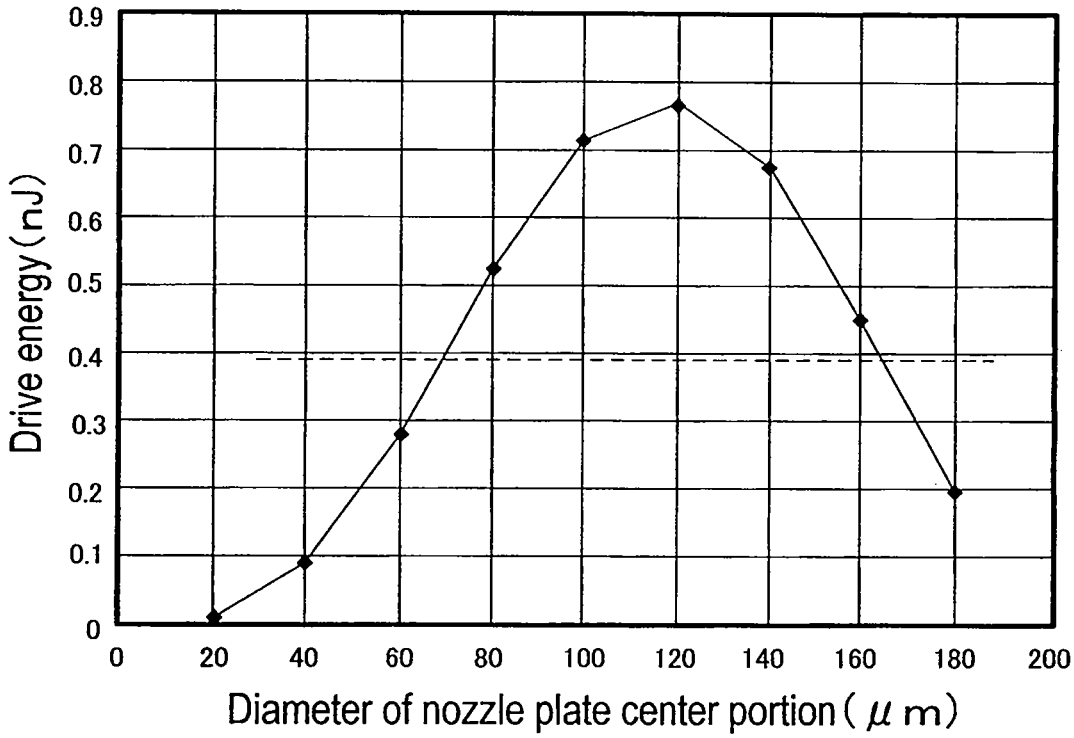
FIG. 9 is a graph illustrating a variation in drive energy of the inkjet head relative to a variation in a diameter of a center area of the nozzle plate in Example 1 of the first embodiment.
Figure 10:
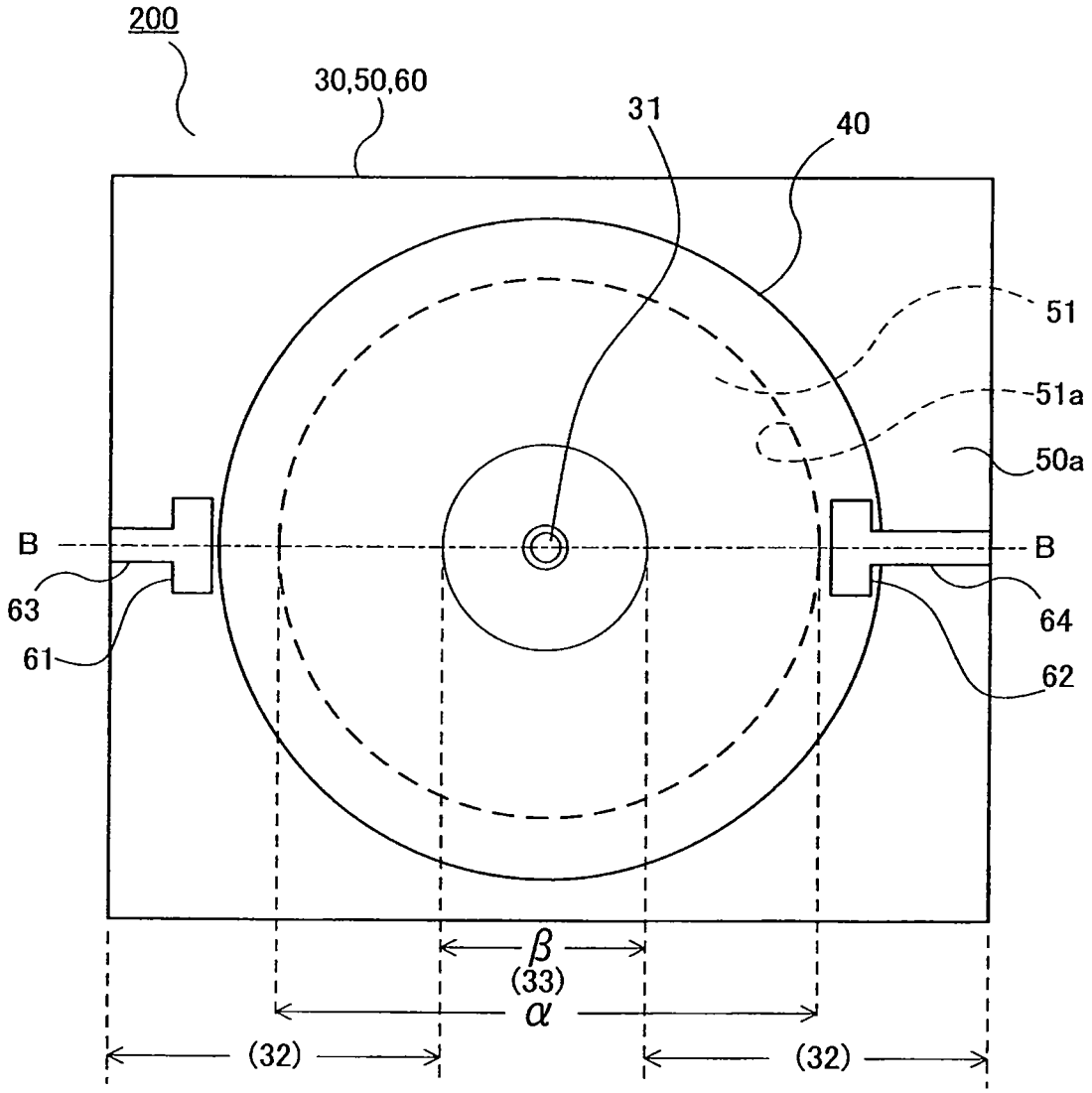
FIG. 10 is a top view partly illustrating the inkjet head of a first modification of the first embodiment.
Figure 11:
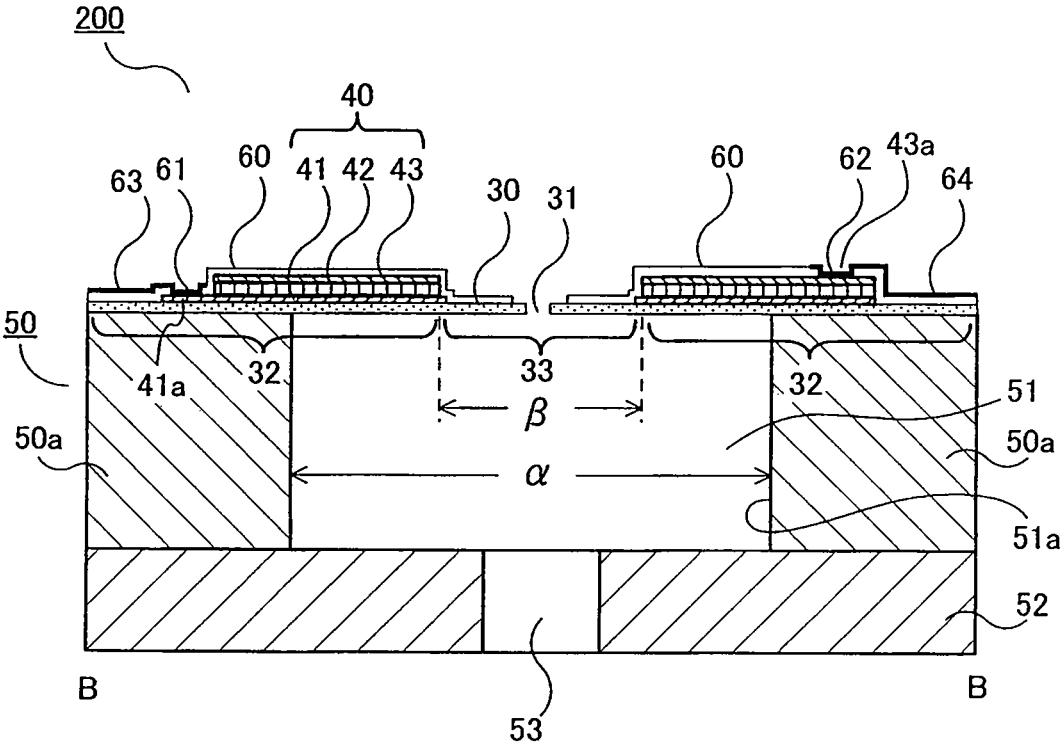
FIG. 11 is a schematic cross-sectional view of the inkjet head taken along a line B-B of FIG. 10.

The variation in the diameter β of the center area 33 varies the drive energy of the inkjet head 100 as illustrated in FIG. 9. If the diameter β of the center area 33 of the nozzle plate 30 is 120 μm, the total drive energy assumes a maximum value.

If the total drive energy of the inkjet head 100 is ½ or more of the maximum drive energy, the ink droplet can be properly ejected from the nozzle 31. Thus, as can be seen from FIG. 9, if the diameter β of the center area 33 of the nozzle plate 30 is in a range of 70 μm or more and 160 μm or less, the inkjet head 100 can eject the ink droplet properly.

With regard to the drive volume of the inkjet head 100, simulation of a ratio of the diameter β of the center area 33 was performed under a condition that the inner diameter α of the pressure generating chamber 51 was set to 1. If the diameter β is in a range of 0.5 to 0.6, the drive volume of the inkjet head 100 of the entire nozzle plate 30, assumes a maximum value. If the diameter β is in a range of 0.25 to 0.85, the inkjet head 100 can obtain ½ of the maximum drive volume.

With regard to the total drive energy of the inkjet head 100, simulation of a ratio of the diameter β of the center area 33 was performed under a condition that the inner diameter α of the pressure generating chamber 51 was set to 1. If the diameter β is 0.6, the total drive energy of the inkjet head 100 assumes a maximum value. If the diameter β is in a range of 0.35 to 0.8, the inkjet head 100 can obtain ½ of the maximum drive energy. If the diameter β is in a range of 0.25 to 0.9, the inkjet head 100 can obtain ¼ or more of the maximum drive energy.

Thus, at least if the diameter β is in a range of 0.25 to 0.9, the inkjet head 100 can obtain drive energy required to eject the ink droplet from the nozzle 31. However, more desirably, the diameter β is in a range of 0.35 to 0.8 in order for the inkjet head 100 to eject the ink droplet properly.

According to the first embodiment, the annular shaped piezoelectric element 40 is formed on the nozzle plate 30 at a portion above the peripheral area 32 of the pressure generating chamber 51. The parts 41*a* and 43*a* of the lower and upper electrodes 41 and 43 constituting the external wirings 141 and 143, respectively, are each formed in a fixed area of the nozzle plate 30 above the partition wall 50*a* of the pressure generating chamber 51. Thus, crack of the external wirings 141 and 143 or peeling of a connection portion between the lower electrode 41 and external wiring 141 or between the upper electrode 43 and external wiring 143 can be suppressed. According to the first embodiment, an electric signal can be reliably supplied to the lower and upper electrodes 41 and 43 to thereby enhance reliability of the inkjet head 100. Further, the piezoelectric element 40 has a symmetrical shape about the nozzle 31 at a portion above the pressure generating chamber 51, whereby satisfactory ink ejection characteristics can be obtained.

According to the first embodiment, the piezoelectric element 40 has an annular shape having the circular center area 33 around the nozzle 31, and an inner periphery 40*a* of the piezoelectric element 40 is not close to the nozzle 31. Thus, if a patterning position of the piezoelectric element 40 is slightly displaced at manufacturing time, a shape of the nozzle 31 is not adversely influenced. It is possible to simplify a manufacturing process of the piezoelectric element 40 or external wiring and to suppress a reduction in manufacturing yield caused due to deformation of the nozzle 31.

First Modification of First Embodiment

The structure of the inkjet head according to the first embodiment is not limited. The first embodiment may be modified as a first modification illustrated in FIGS. 10 and 11. That is, the nozzle plate 30 and piezoelectric element 40 may be covered from above by an insulating film 60. In an inkjet head 200 of a first modification in which the nozzle plate 30 and piezoelectric element 40 are covered by the insulating film 60, a first contact hole 61 and a second contact hole 62 are formed in the insulating film 60. The first and second contact holes 61 and 62 are located above the partition wall 50*a* of the pressure generating chamber 51.

The lower electrode 41 of the piezoelectric element 40 is connected to an external wiring 63 through the first contact hole 61. The upper electrode 43 of the piezoelectric element 40 is connected to an external wiring 64 through the second contact hole 62.

The insulating film 60 of a silicon dioxide film ($SiO_2$ film) or a silicon nitride film (SiN film) is formed by spin-coating to the nozzle plate 30 from above the piezoelectric element 40. After the film formation, the insulating film 60 is patterned to form the first and second contact holes 61 and 62 located above the partition wall 50*a*. The part 41*a* of the lower electrode 41 is exposed at a position corresponding to the first contact hole 61. The part 43*a* of the upper electrode 43 is exposed at a position corresponding to the second contact hole 62. A material of the insulating film 60 is not especially limited; however, preferably, the insulating film 60 has an ink-repellent property.

For example, a spattering method is used to form as materials of the external wirings 63 and 64, e.g., Al (aluminum) film, a Cu (copper) film, or an Au (gold) film, on the insulating film 60 in which the first and second contact holes 61 and 62 are formed.

Then, the materials of the external wirings 63 and 64 are patterned by the photolithography and reactive ion etching to form the external wirings 63 and 64.

Also in the first modification, the first and second contact holes 61 and 62 are not formed in an area where the nozzle plate 30 is deformed, but in an area above the partition wall 50*a* where the position of the nozzle plate 30 is fixed. Thus, crack of the external wirings 63 and 64 can be suppressed, and the lower and upper electrodes 41 and 43 can be reliably connected to the external wirings 63 and 64 through the first and second contact holes 61 and 62, respectively. Also in the first modification, an electric signal can be reliably supplied to the lower and upper electrodes 41 and 43 to thereby enhance reliability of the inkjet head 200. Further, the piezoelectric element 40 has a symmetrical shape about the nozzle 31 at a portion above the pressure generating chamber 51 and can thus be driven uniformly about the nozzle 31, whereby satisfactory ink ejection characteristics can be obtained. Furthermore, the displacement in the patterning process for the piezoelectric element 40 does not adversely influence the shape of the nozzle 31, thereby suppressing a reduction in manufacturing yield.

Second Embodiment

An inkjet head 300 of a second embodiment will be described with reference to FIGS. 12 to 16. The second embodiment differs from the first embodiment in that an annular protective film is formed in the center area of the nozzle plate. In the second embodiment, the same reference numerals are given to the same configurations as those in the first embodiment, and detailed description thereof is omitted.

Figure 12:
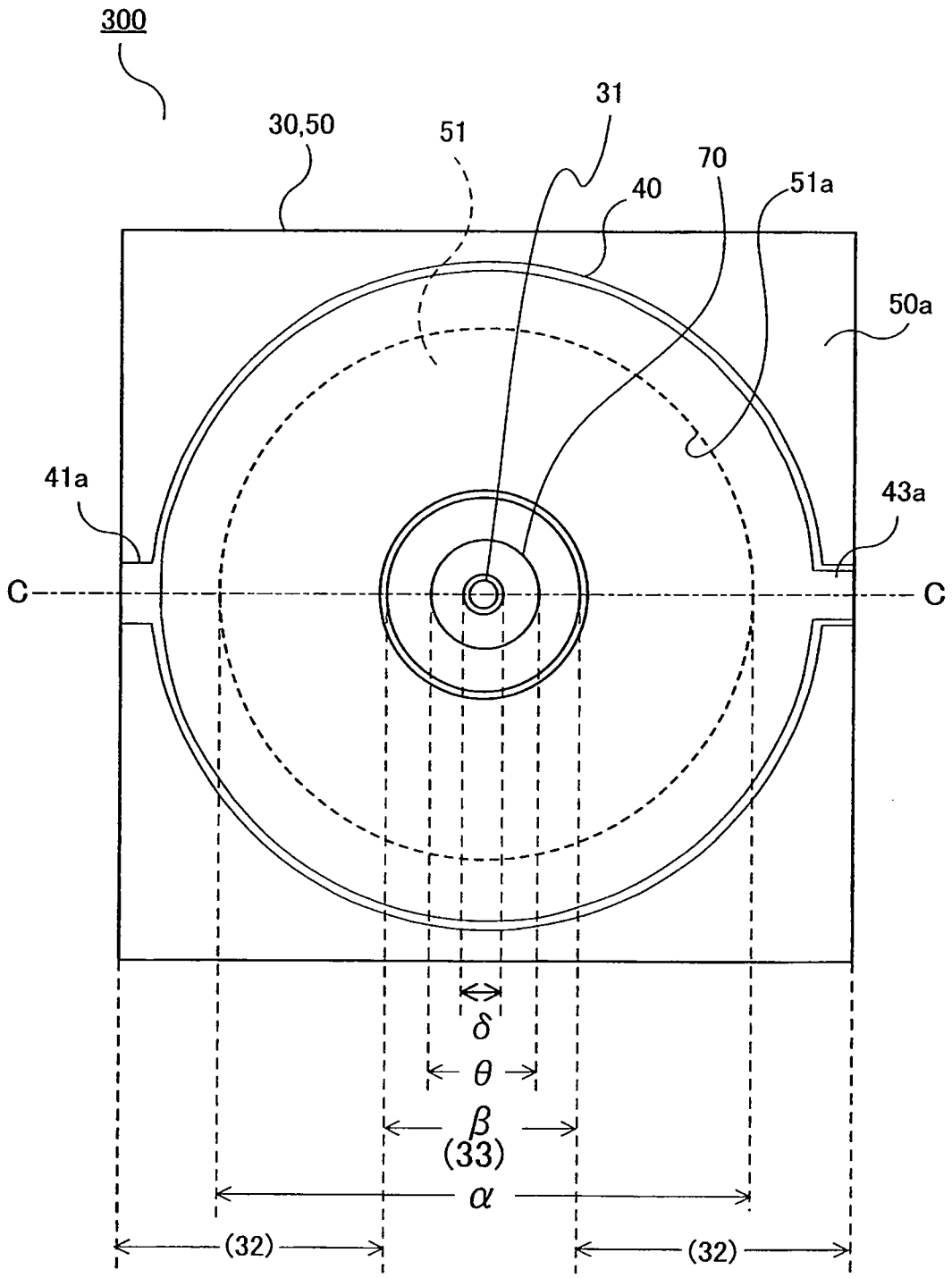
FIG. 12 is a top view partly illustrating the inkjet head of a second embodiment.
Figure 13:
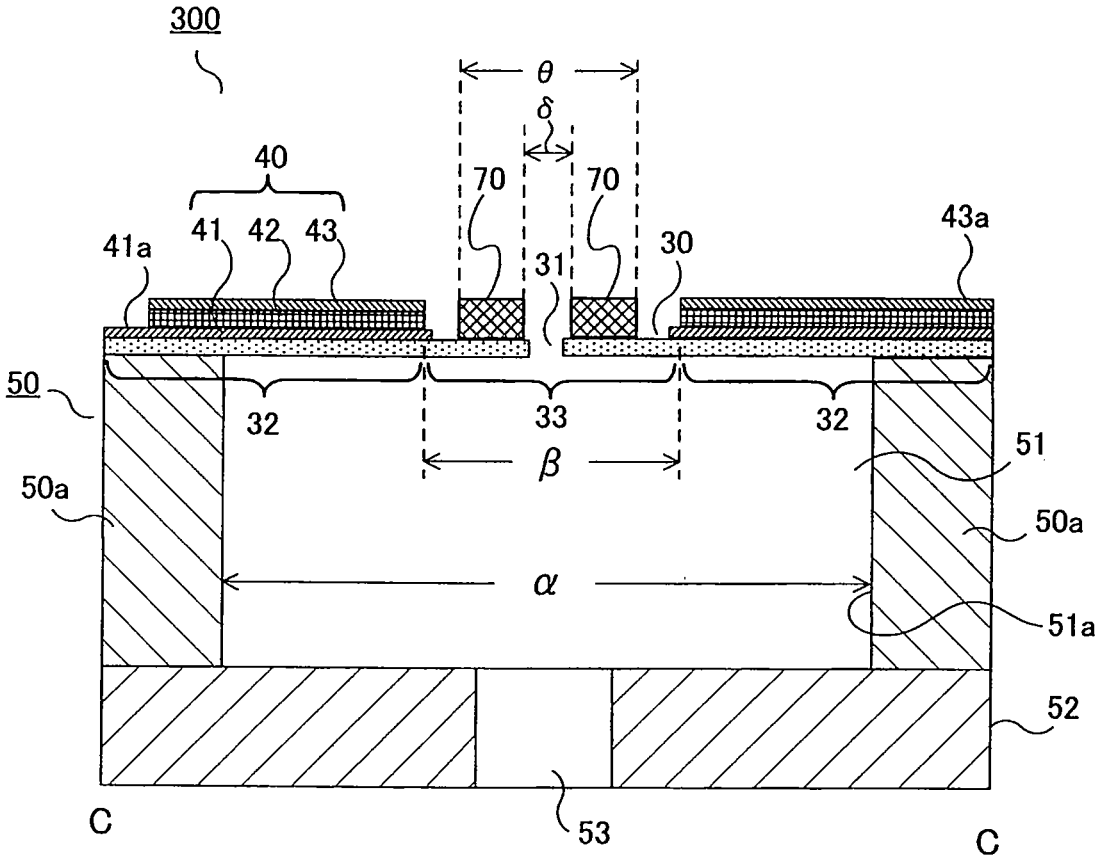
FIG. 13 is a schematic cross-sectional view of the inkjet head taken along a line C-C of FIG. 12.

As illustrated in FIGS. 12 and 13, the inkjet head 300 includes a protective film 70 as a covering layer covering a part of the center area 33 of the nozzle plate 30. The protective film 70 is formed into an annular shape extending about the nozzle 31. In the second embodiment, as the nozzle plate 30, a thermally-oxidized silicon film (silicon dioxide film ($SiO_2$ film)) having a large compression residual stress is used. At manufacturing time, a silicon substrate constituting the pressure chamber structure 50 is subjected to surface treatment by thermal oxidation in which heating treatment is performed in an oxygen atmosphere to form the thermally-oxidized silicon film as the nozzle plate 30 on the first surface of the pressure chamber structure 50.

For example, as the protective film 70, polyimide having an ink-repellent property is used. The protective film 70 suppresses adherence of the ink to a circumference of the nozzle 31. The protective film 70 is manufactured as follows: solution containing a polyimide precursor is coated by spin-coating onto the nozzle plate 30 having the piezoelectric element 40; the spin-coated solution containing polyimide precursor is thermally polymerized by baking to remove solvent to thereby form a polyimide film on the nozzle plate 30; and the formed polyimide film is patterned by the photolithography and reactive ion etching to form the protective film 70 into an annular shape.

An inner diameter δ of the protective film 70 is desirably equal to or slightly larger than an inner diameter of the nozzle 31. A diameter θ of the protective film 70 is desirably smaller than the diameter β of the center area 33 of the nozzle plate 30. However, the diameter θ of the protective film 70 may be larger than the diameter β of the center area 33, and the protective film 70 may be extended up to the peripheral area of the nozzle plate 30. A shape and a size of the protective film 70 can be arbitrarily set as long as the protective film 70 does not prevent deformation of the nozzle plate 30 when the nozzle plate 30 is driven by the piezoelectric element 40.

The material of the protective film 70 is not limited to the polyimide. As the protective film 70, another insulating material such as an organic material can be used. Desirably, the protective film 70 has an ink-repellent property.

Example 2

As Example 2, a Finite Element Method was used to simulate characteristics of the inkjet head 300 of the second embodiment. Example 2 is an example of simulation of characteristics of the inkjet head 300 if drive voltage is applied to the piezoelectric film 42 through the lower and upper electrodes 41 and 43 of the piezoelectric element 40.

Figures 14, 15:
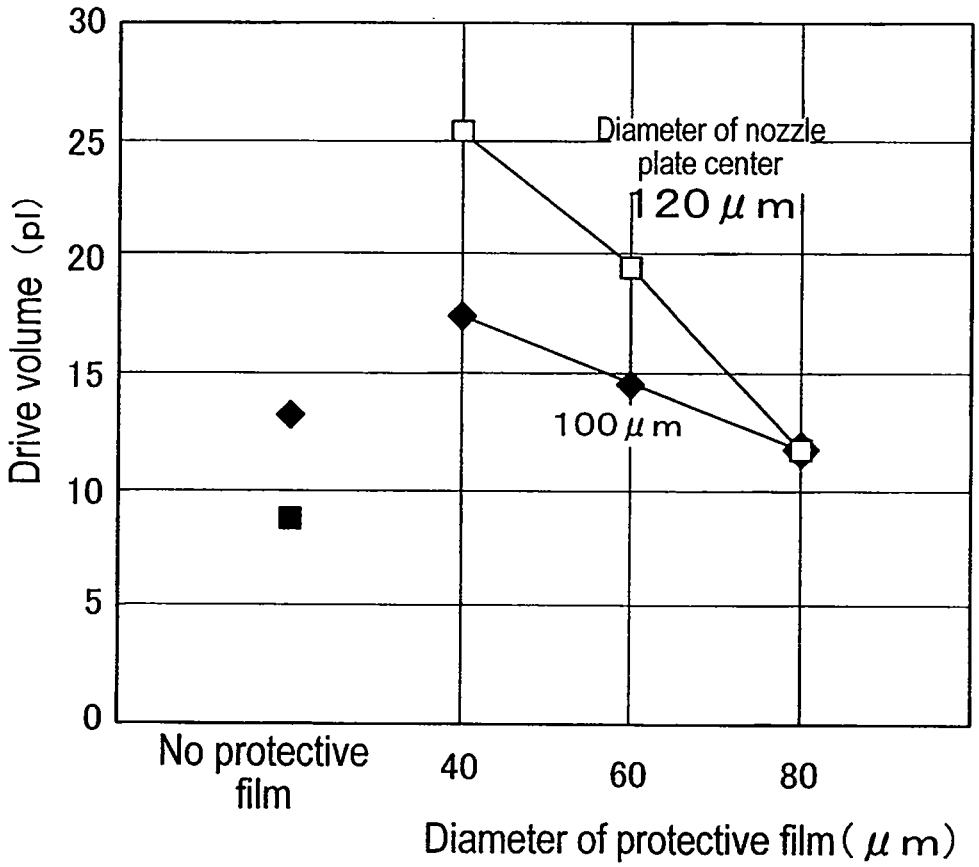
FIG. 14 is a table (Table 2) listing dimensions of main components of the inkjet head of Example 2 of the second embodiment.
FIG. 15 is a graph illustrating a variation of the drive volume of the inkjet head relative to a variation of a diameter of a protective film in Example 2 of the second embodiment.

As an example, dimensions of main components of the inkjet head 300 used in the simulation are listed in Table 2 of FIG. 14. The diameter α of the pressure generating chamber 51 of the silicon pressure chamber structure 50 of the inkjet head 300 was set to 200 μm. The nozzle plate 30 is formed on the surface of the pressure chamber structure 50 by thermal oxidation, and the thickness thereof was set to 4 μm. The diameter of the opening portion of the nozzle 31 formed in the nozzle plate 30 was set to 20 μm.

The diameter of the center area 33 of the piezoelectric element 40 on the nozzle plate 30 was set to 120 μm. The thicknesses of the lower electrode 41, piezoelectric film 42, and upper electrode 43 of the piezoelectric element 40 were set to 0.1 μm, 2 μm, and 0.1 μm, respectively.

The diameter θ of the protective film 70 to be formed in the center area 33 of the nozzle plate 30 was set to 40 μm. The platinum (Pt) was used as the lower and upper electrodes 41 and 43, and the lead zirconate titanate (PZT) was used as the piezoelectric film 42. Polyimide was used as the protective film 70. The piezoelectric constant number d31 of the piezoelectric film 42 was set to −100 pm/V. Film residual stresses of the nozzle plate 30, piezoelectric film 42, and protective film 70 were set to −270 MPa, 56 MPa, and 84 MPa, respectively.

Calculation based on the simulation performed under the condition that 30 V is applied between the lower and upper electrodes 41 and 43 revealed that a vertical direction deformation of the nozzle plate 30 at a position of the nozzle 31 (center of the pressure generating chamber 51) was 2.43 μm. The drive volume of the entire nozzle plate 30 was 25.7 pl (pico-liter).

A drive pressure required to deform the nozzle plate 30 by 2.43 μm at the center of the pressure generating chamber 51 was 0.20 MPa, and total drive energy of the inkjet head 300 of Example 2 was calculated to be 2.54 nJ.

For example, if an ink droplet containing organic solvent or aqueous solution with a volume of 25 pl (pico-liter) is ejected at a speed of 10 m/s, a sum of surface energy and kinetic energy of the ink droplet is about 0.5 nJ to 1.5 nj. Thus, it turns out that the inkjet head 300 of Example 2 has drive energy sufficient enough to eject the ink droplet of the ink in the pressure generating chamber 51 having a volume of about 25 pl (pico-liter) at a speed of 10 m/s from the nozzle 31.

The following describes simulation results obtained if the diameter θ of the protective film 70 is changed in a range of 40 μm to 80 μm for each of the cases where the diameter β of the center area 33 of the nozzle plate 30 is set to 100 μm and 120 μm in Example 2.

Figure 16:
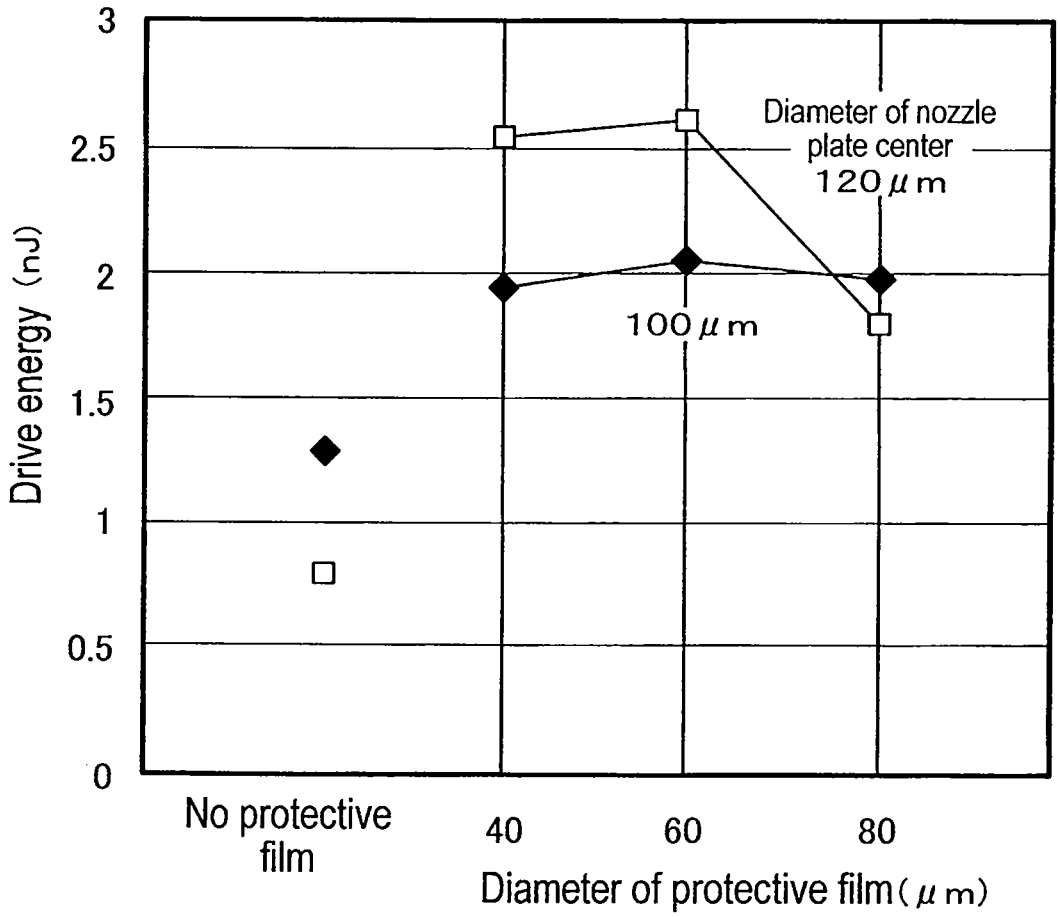
FIG. 16 is a graph illustrating a variation of the drive energy of the inkjet head relative to a variation of a diameter of a protective film in Example 2 of the second embodiment.

Influence that the diameter θ of the protective film 70 exerts on the drive volume of the inkjet head 300 is illustrated in FIG. 15. Influence that the diameter θ of the protective film 70 exerts on the total drive energy of the inkjet head 300 is illustrated in FIG. 16. The inkjet head 300 of Example 2 provided with the protective film 70 is increased both in drive volume and drive energy as compared to the inkjet head 100 of Example 1, regardless of a size of the protective film 70.

The drive volume of the inkjet head 300 assumes a maximum value if the diameter θ of the protective film 70 is 40 μm. The drive energy of the inkjet head 300 assumes a maximum value if the diameter of the protective film 70 is 60 μm.

As compared to the inkjet head 100 of Example 1, the nozzle plate 30 of the inkjet head 300 of Example 2 formed by the thermal oxidation is larger in the film residual stress. The inkjet head 300 of Example 2 is increased in drive energy by synergistic effect between the film residual stress of the nozzle plate 30 and protective film 70. As a result, if the same voltage is applied between the lower and upper electrodes 41 and 43 to compare drive efficiency in the Example 1 and in the Example 2, the inkjet head 300 of Example 2 obtains higher drive efficiency.

As in the first embodiment, according to the second embodiment, the parts 41*a* and 43*a* of the lower and upper electrodes 41 and 43 constituting the external wirings 141 and 143, respectively, are each formed in a fixed area of the nozzle plate 30 above the partition wall 50*a* of the pressure generating chamber 51. Thus, crack of the external wirings 141 and 143 or peeling of a connection portion between the lower electrode 41 and external wiring 141 or between the upper electrode 43 and external wiring 143 can be suppressed. According to the second embodiment, an electric signal can be reliably supplied to the lower and upper electrodes 41 and 43 to thereby enhance reliability of the inkjet head 300. Further, the piezoelectric element 40 has a symmetrical shape about the nozzle 31 at a portion above the pressure generating chamber 51, whereby satisfactory ink ejection characteristics can be obtained. Further, the inner periphery 40*a* of the piezoelectric element 40 is not close to the nozzle 31. Thus, if a patterning position of the piezoelectric element 40 is slightly displaced, a shape of the nozzle 31 is not adversely influenced. It is possible to simplify a manufacturing process of the piezoelectric element 40 or external wiring and to suppress a reduction in manufacturing yield caused due to deformation of the nozzle 31.

Furthermore, according to the second embodiment, the annular protective film 70 formed of polyimide having an ink-repellent property is formed in the center area 33 of the nozzle plate 30 having a large film residual stress. This suppresses adherence of the ink to the circumference of the nozzle 31 to thereby suppress poor ejection of the ink from the inkjet head 300 and further to increase drive efficiency of the inkjet head 300 to increase ink ejection force.

Third Embodiment

An inkjet head 400 of a third embodiment will be described with reference to FIGS. 17 to 21. The third embodiment differs from the first embodiment in that pressure generating chamber has a rectangular shape as viewed from above. In the third embodiment, the same reference numerals are given to the same configurations as those in the first embodiment, and detailed description thereof is omitted.

Figure 17:
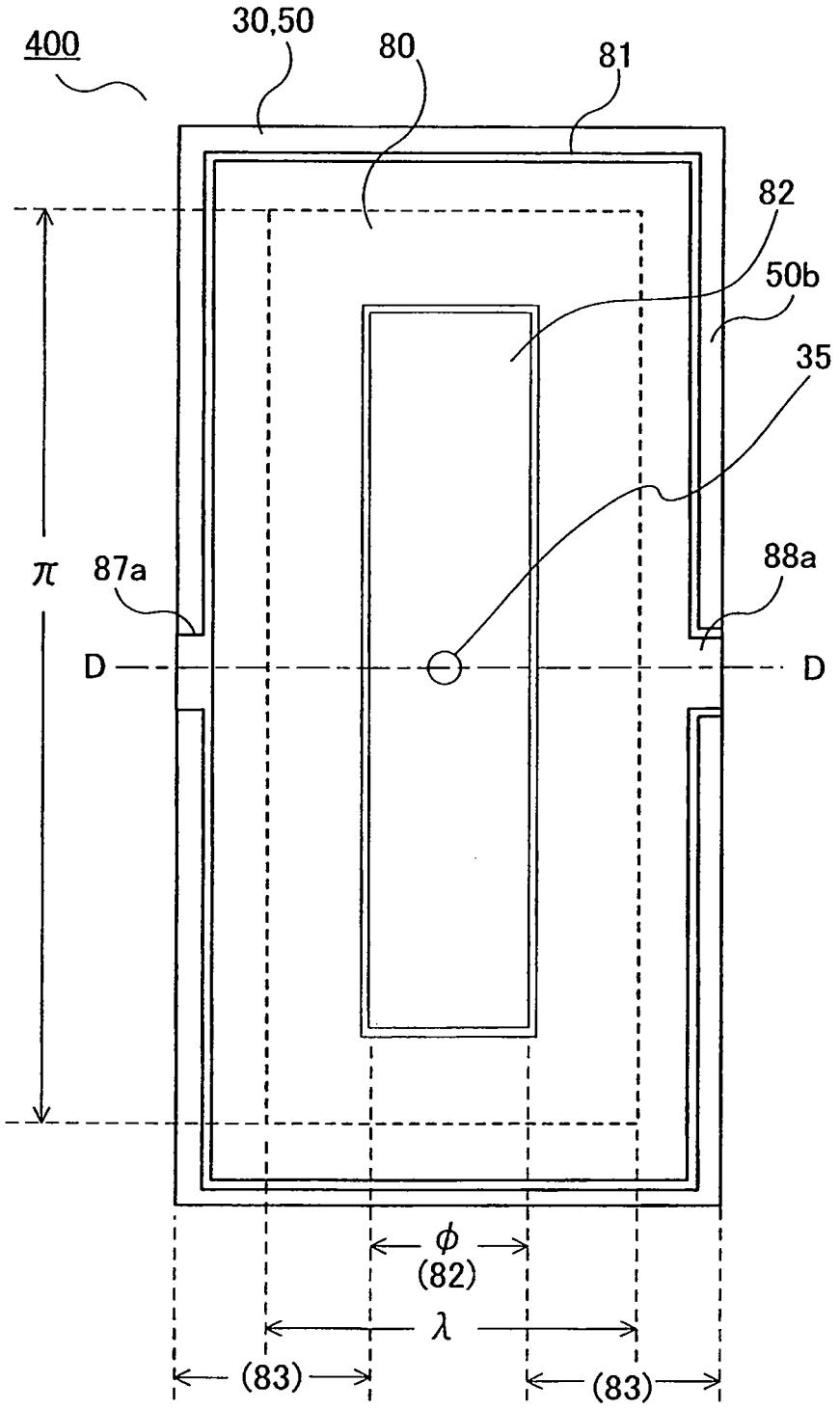
FIG. 17 is a top view partly illustrating the inkjet head of a third embodiment.
Figure 18:
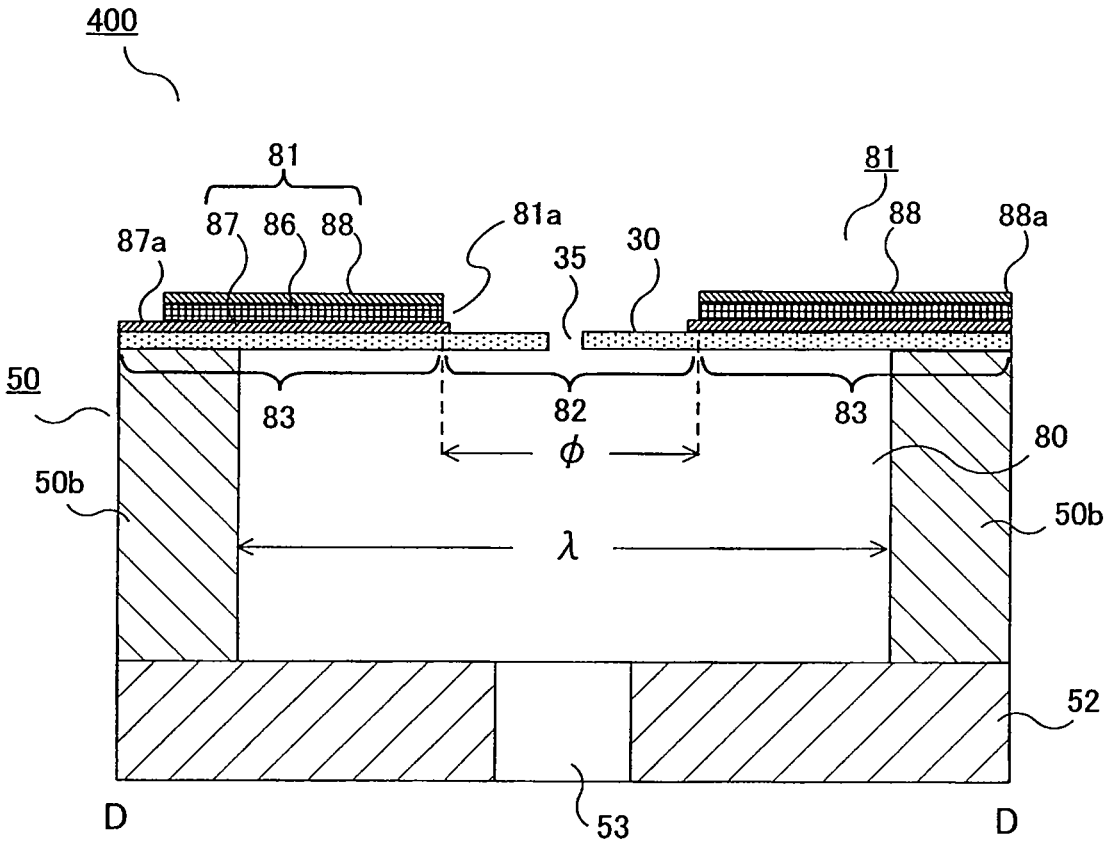
FIG. 18 is a schematic cross-sectional view of the inkjet head taken along a line D-D of FIG. 17.

As illustrated in FIGS. 17 and 18, the inkjet head 400 includes a pressure generating chamber 80 having a rectangular shape as viewed from above in the pressure chamber structure 50. A width and a length of the pressure generating chamber 80 are λ and π, respectively. The nozzle plate 30 is formed integrally with a partition wall 50*b* of the pressure chamber structure 50. The nozzle plate 30 has a nozzle 35 at a center (e.g., intersection of diagonal lines of the pressure generating chamber 80) of the pressure generating chamber 80.

The nozzle plate 30 has a rectangular piezoelectric element 81 having a similar shape to the pressure generating chamber 80. The piezoelectric element 81 has, around the nozzle 35, a rectangular center area 82 having a similar shape to the pressure generating chamber 80. The piezoelectric element 81 is not formed in the center area 82. The piezoelectric element 81 includes a piezoelectric film 86 and lower and upper electrodes 87 and 88 sandwiching therebetween the piezoelectric film 86. The lower electrode 87 has an extended part 87*a* serving as a part of an external wiring 141. The upper electrode 88 has an extended part 88*a* serving as a part of an external wiring 143. The extended part 88*a* is extended with the piezoelectric film 86 and the lower electrode 87 which are formed under the upper electrode 88.

The piezoelectric element 81 is formed on the nozzle plate 30 and above a peripheral area 83 of the pressure generating chamber 80 so as to extend, in a direction toward the nozzle 35, from above the partition wall 50*b* of the nozzle plate 30 up to above the pressure generating chamber 80. The center area 82 of the nozzle plate 30 where the piezoelectric element 81 is not formed can be freely deformed in the thickness direction thereof.

A size of the center area 82 of the nozzle plate 30 is not especially limited as long as the nozzle plate 30 can be deformed by the action of the piezoelectric element 81.

Example 3

As Example 3, a Finite Element Method was used to simulate characteristics of the inkjet head 400 of the third embodiment. Example 3 is an example of simulation of characteristics of the inkjet head 400 if drive voltage is applied to the piezoelectric film 86 through the lower and upper electrodes 87 and 88 of the piezoelectric element 86.

Figures 19, 20:
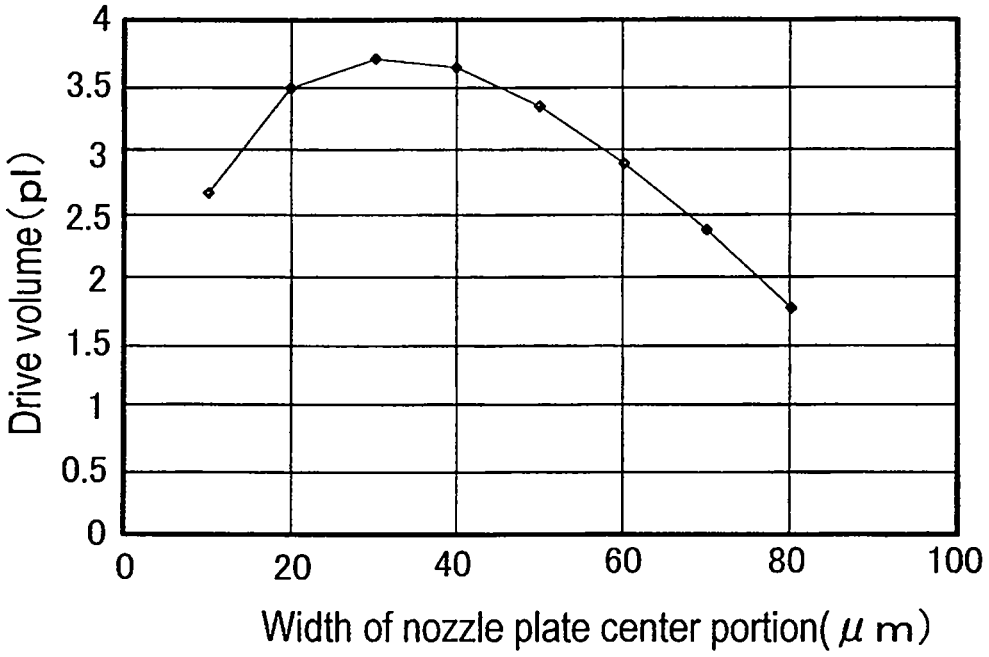
FIG. 19 is a table (Table 3) listing dimensions of main components of the inkjet head of Example 3 of the third embodiment.
FIG. 20 is a graph illustrating a variation of the drive volume of the inkjet head relative to a variation of a diameter of the center area of the nozzle plate in Example 3 of the third embodiment.

As an example, dimensions of main components of the inkjet head 400 used in the simulation are listed in Table 3 of FIG. 19. A width λ of the pressure generating chamber 80 of the silicon pressure chamber structure 80 of the inkjet head 400 was set to 100 μm, and a length π thereof was set to 400 μm. An area $100\times 400\ (\mu m)^2$ of the pressure generating chamber 80 is brought close to an area $100\times 100\times \pi\ (\mu m)^2$ of the pressure generating chamber 51 of Example 1.

The thickness of the nozzle plate 30 of silicon dioxide ($SiO_2$) formed on the surface of the pressure chamber structure 80 by the CVD method was set to 4 μm. The diameter of an opening portion of the nozzle 35 formed in the nozzle plate 30 was set to 20 μm.

A width ϕ of the center area 82 of the piezoelectric element 81 on the nozzle plate 30 was set to 30 μm. The thicknesses of the lower electrode 87, piezoelectric film 86, and upper electrode 88 of the piezoelectric element 81 were set to 0.1 μm, 2 μm, and 0.1 μm, respectively.

The platinum (Pt) was used as the lower and upper electrodes 87 and 88, and the lead zirconate titanate (PZT) was used as the piezoelectric film 86. A piezoelectric constant number d31 of the piezoelectric film 86 was set to −100 pm/V. Film residual stresses of the nozzle plate 30 and piezoelectric film 86 were set to 0 MPa and 56 MPa, respectively.

Calculation based on the simulation performed under the condition that 30 V is applied between the lower and upper electrodes 87 and 88 revealed that a vertical direction deformation of the nozzle plate 30 at a position of the nozzle 35 (center of the nozzle plate 30) was 0.23 μm. A drive volume of the entire nozzle plate 30 was 3.7 pl (pico-liter).

A drive pressure required to deform the center of the nozzle plate 30 by 0.23 μm was 0.69 MPa, and total drive energy of the inkjet head 400 of Example 3 was calculated to be 1.29 nJ.

As compared to the inkjet head 100 of Example 1, drive force applied to the nozzle plate 30 of the inkjet head 400 of Example 3 by the pressure generating chamber 80 extending in a direction of the length m is smaller. On the other hand, as compared to the inkjet head 100 of Example 1 in which the circumference of the nozzle 31 is surrounded uniformly by the piezoelectric element 40, the nozzle plate 30 of the inkjet head 400 of Example 3 is easier to be deformed.

Thus, as compared to the inkjet head 100 of Example 1, the inkjet head 400 of the Example 3 is smaller in drive volume but larger in total drive energy. That is, an ink ejection amount of Example 3 is 700 of that in the inkjet head 100 of Example 1, but ink ejection energy of Example 3 is 1.7 times that of the inkjet head 100 of Example 1. This reveals that, as compared to the inkjet head 100 of Example 1, the inkjet head 400 of Example 3 is more suitable for ejection of ink having higher viscosity.

The following describes variations in the drive volume and total drive energy of the inkjet head 400 if the width ϕ of the center area 82 of the nozzle plate 30 is varied in Example 3. In Example 3, the Finite Element Method was used to perform simulation by varying the width ϕ of the center area 82. The variation in the width ϕ of the center area 82 varies the drive volume of the inkjet head 400 as illustrated in FIG. 20. If the width ϕ of the center area 82 of the nozzle plate 30 is about 30 μm, the drive volume assumes a maximum value.

Figure 21:
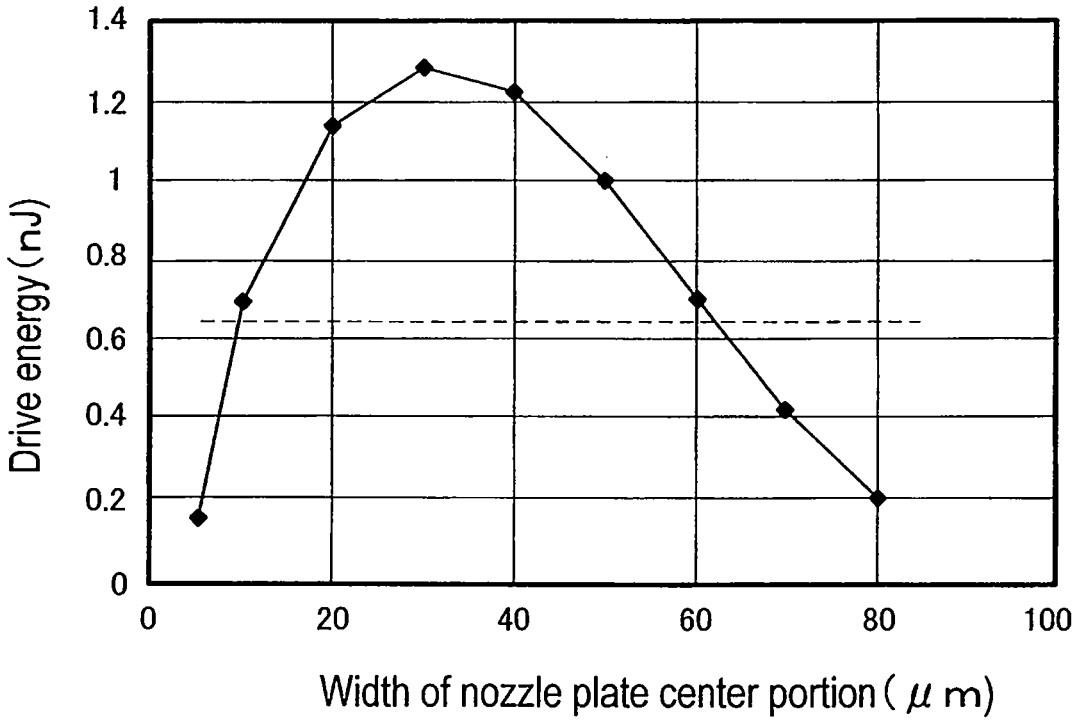
FIG. 21 is a graph illustrating a variation of the drive energy of the inkjet head relative to a variation of a diameter of the center area of the nozzle plate in Example 3 of the third embodiment.

The variation in the width ϕ of the center area 82 varies the drive energy of the inkjet head 400 as illustrated in FIG. 21. If the width ϕ of the center area 82 of the nozzle plate 30 is 30 μm, the total drive energy assumes a maximum value.

If the total drive energy of the inkjet head 400 is ½ or more of the maximum drive energy, the ink droplet of the ink in the pressure generating chamber 80 can be properly ejected from the nozzle 35. Thus, as can be seen from FIG. 21, if the width ϕ of the center area 82 of the nozzle plate 30 is in a range of 10 μm or more and 60 μm or less, the inkjet head 400 can eject the ink droplet properly. That is, assuming that the width λ of the pressure generating chamber 80 is 1, if the width ϕ of the center area 82 of the nozzle plate 30 is in a range of 0.1 or more and 0.6 or less, the inkjet head 400 can eject the ink droplet properly.

With regard to the total drive energy of the inkjet head 400, simulation of a ratio of the minimum width ϕ of the center area 82 that includes the nozzle 35 was performed assuming that the minimum width λ of the pressure generating chamber 80 is 1. If the width ϕ is 0.3, the total drive energy of the inkjet head 400 assumes a maximum value. If the width ϕ is in a range of 0.1 to 0.6, ½ of the maximum drive energy can be obtained. If the width ϕ is in a range of 0.05 to 0.75, ¼ or more of the maximum drive energy can be obtained.

Thus, at least if the width ϕ is in a range of 0.05 to 0.75, the inkjet head 400 can obtain drive energy required to eject the ink droplet from the nozzle 35. However, more desirably, the width ϕ is in a range of 0.1 to 0.6 in order for the inkjet head 400 to eject the ink droplet properly.

As in the first embodiment, according to the third embodiment, the parts 87*a* and 88*a* of the lower and upper electrodes 87 and 88 constituting the external wirings 141 and 143, respectively, are each formed in a fixed area of the nozzle plate 30 above the partition wall 50*b* of the pressure generating chamber 80. Thus, crack of the external wirings 141 and 143 or peeling of a connection portion between the lower electrode 87 and external wiring 141 or between the upper electrode 88 and external wiring 143 can be suppressed. According to the third embodiment, an electric signal can be reliably supplied to the lower and upper electrodes 87 and 88 to thereby enhance reliability of the inkjet head 400. Further, the piezoelectric element 81 has a symmetrical shape about the nozzle 35 at a portion above the pressure generating chamber 80, whereby satisfactory ink ejection characteristics can be obtained. Further, an inner periphery 81*a* of the piezoelectric element 81 is not close to the nozzle 35. Thus, if a patterning position of the piezoelectric element 81 is slightly displaced, a shape of the nozzle 35 is not adversely influenced. It is possible to simplify a manufacturing process of the piezoelectric element 81 or external wiring and to suppress a reduction in manufacturing yield caused due to deformation of the nozzle 35.

Furthermore, according to the third embodiment, although the ink ejection amount is smaller than that in the ink head provided with the pressure generating chamber having a circular shape as viewed from above, the ink ejection energy can be increased. Thus, as compared to the inkjet head provided with the pressure generating chamber having a circular shape as viewed from above, the inkjet 400 of the third embodiment is more suitable for ejection of ink having higher viscosity.

The structure of the inkjet head 400 according to the third embodiment is not limited. An insulating film may be formed on an upper surface of the piezoelectric element 81, and the lower electrode 87 or upper electrode 88 may be connected to the external winding through a contact hole formed in the insulating film. Further, in order to increase the drive efficiency of the inkjet head 400, a protective film such as a polyimide film corresponding to the protective film 70 of the second embodiment may be formed in the center area 82 of the inkjet head 400.

In the above-described embodiments, the material, shape, or size of the pressure generating chamber is not limited. The material of the pressure chamber structure is not limited to a silicon single crystal substrate, but may be any other semiconductor single crystal substrate. The planar shape of the pressure generating chamber is not limited to a circular or rectangular shape; the pressure generating chamber may be formed into any shape, such as a diamond shape, ellipsoidal shape, or a polygonal shape, depending on the intended use. Further, the width of the center area of the nozzle plate relative to the width of the pressure generating chamber is not limited, and, assuming that the width of the pressure generating chamber is 1, it is only necessary for the width of the center area to be 0.1 or more and 0.8 or less. The shape or material of the piezoelectric element is not limited, and piezoelectric characteristics of the piezoelectric body may be arbitrarily set.

The structure of the inkjet head is not limited. For example, the inkjet head need not have the back plate having an ink supply hole having a diameter smaller than that of the pressure generating chamber, between the pressure generating chamber and ink channel. However if the inkjet head need not have the back plate, it is preferable to increase the size of the pressure generating chamber in a depth direction. The increase in the size of the pressure generating chamber in a depth direction impedes an energy change to be generated in the pressure generating chamber from escaping to the ink channel due to deformation of the nozzle plate.

According to at least one of the embodiments described above, the drive section on the nozzle plate extends above the peripheral area of the pressure chamber, and the peripheral is from above the partition wall of the pressure chamber to above the pressure chamber. The wiring for supplying an electric signal to the drive section is formed at an area where the nozzle plate above the partition wall of the pressure chamber is fixed. Thus, crack of the external wiring or peeling of a connection portion between the electrode of the piezoelectric element and external wiring can be suppressed to enhance reliability of the inkjet head. Further, the drive section has a symmetrical shape about the nozzle above the pressure generating chamber, whereby satisfactory ink ejection characteristics can be obtained. Furthermore, the center area is provided around the nozzle of the nozzle plate, so that even if a patterning position of the drive section is displaced, it is possible to prevent a shape of the nozzle from being adversely influenced. Thus, it is possible to simplify a manufacturing process and to suppress a reduction in manufacturing yield caused due to deformation of the nozzle.

While certain embodiments have been described these embodiments have been presented by way of example only, and are not intended to limit the scope of the inventions. Indeed, the novel apparatus and methods described herein may be embodied in a variety of other forms: furthermore various omissions, substitutions and changes in the form of the apparatus and methods described herein may be made without departing from the spirit of the inventions. The accompanying claims and there equivalents are intended to cover such forms of modifications as would fall within the scope and spirit of the invention.

What is claimed is:

1. An inkjet head comprising:

a pressure chamber in which ink is to be filled;

a nozzle plate which is formed as a first surface of the pressure chamber and which includes a nozzle communicating with the pressure chamber; and a planar drive section which is formed on the nozzle plate, and which has a piezoelectric body and an electrode for applying voltage to the piezoelectric body, the piezoelectric body and the electrode extending from a position corresponding to a partition wall of the pressure chamber to an edge of an area around the nozzle.

2. The inkjet head according to claim 1, wherein the electrode is connected to an external wiring above the partition wall.

3. The inkjet head according to claim 1, wherein a ratio of a width of the hole area at a position included in the minimum width of the pressure chamber is 0.1 or more and 0.8 or less, if the minimum width of the pressure chamber is 1.

4. The inkjet head according to claim 1, wherein a planar shape of the pressure chamber is a circular shape, and the drive section shapes an annular shape which extends from above the partition wall of the pressure chamber toward the nozzle and at a center of which the hole area having a circular shape is disposed.

5. The inkjet head according to claim 1, wherein a planar shape of the pressure chamber is a polygonal shape, and the drive section extends from above the partition wall of the pressure chamber toward the nozzle and at a center of which the hole area having a similar shape to the planar shape is disposed.

6. The inkjet head according to claim 1, further comprising a covering layer which surrounds the nozzle and covers at least a part of the hole area.

7. The inkjet head according to claim 6, wherein the covering layer shapes an annular shape surrounding the nozzle.

8. The inkjet head according to claim 1, wherein the nozzle plate is integrally formed with the partition wall.

9. The inkjet head according to claim 8, wherein the pressure chamber is formed of silicon single crystal, and the nozzle plate is formed of a silicon dioxide film formed on the first surface of the pressure chamber.

10. An inkjet recording apparatus comprising:

a pressure chamber in which ink is to be filled;

a nozzle plate which is formed as a first surface of the pressure chamber and which includes a nozzle communicating with the pressure chamber;

a planar drive section which is formed on the nozzle plate, which has a piezoelectric body and an electrode for applying voltage to the piezoelectric body, the piezoelectric body and the electrode extending from a position corresponding to a partition wall of the pressure chamber to an edge of an area around the nozzle; and a conveyance section which conveys a recording medium to a position to which the ink is ejected from the nozzle.

11. The apparatus according to claim 10, wherein the electrode is connected to an external wiring above the partition wall.

12. The apparatus according to claim 10, wherein a ratio of a width of the hole area at a position included in the minimum width of the pressure chamber is 0.1 or more and 0.8 or less, if the minimum width of the pressure chamber is 1.

13. The apparatus according to claim 10, wherein a planar shape of the pressure chamber is a circular shape, and the drive section shapes an annular shape which extends from above the partition wall of the pressure chamber toward the nozzle and at a center of which the hole area having a circular shape is disposed.

14. The apparatus according to claim 10, wherein a planar shape of the pressure chamber is a polygonal shape, and the drive section extends from above the partition wall of the pressure chamber toward the nozzle and at a center of which the hole area having a similar shape to the planar shape is disposed.

15. The apparatus according to claim 10, further comprising a covering layer which surrounds the nozzle and covers at least a part of the hole area.

16. The apparatus according to claim 15, wherein the covering layer shapes an annular shape surrounding the nozzle.

17. The apparatus according to claim 10, wherein the nozzle plate is integrally formed with the partition wall.

18. The apparatus according to claim 17, wherein the pressure chamber is formed of silicon single crystal, and the nozzle plate is formed of a silicon dioxide film formed on the first surface of the pressure chamber.

* * * * *